US005455067A

United States Patent [19]

Chicatelli et al.

[11] Patent Number: 5,455,067

[45] Date of Patent: Oct. 3, 1995

[54] APPARATUS AND METHOD FOR APPLYING COATING MATERIAL

[75] Inventors: Donald A. Chicatelli, N. Ridgeville, Ohio; Wataru Kakuta, Kanagawa, Japan

[73] Assignee: Nordson Corporation, Westlake, Ohio

[21] Appl. No.: 181,570

[22] Filed: Jan. 12, 1994

Related U.S. Application Data

[62] Division of Ser. No. 859,343, Mar. 27, 1992, Pat. No. 5,296,035.

[51] Int. Cl.[6] ..... B05D 7/22

[52] U.S. Cl. ..... 427/236; 427/239; 427/385.5; 427/388.1; 427/421; 427/299; 427/327

[58] Field of Search ..... 427/239, 236, 427/385.5, 388.1, 421, 299, 327

[56] References Cited

U.S. PATENT DOCUMENTS

| | | | |
|---|---|---|---|
| 3,179,349 | 4/1965 | Plos et al. | 239/414 |
| 3,876,144 | 4/1975 | Madden et al. | 239/106 |
| 3,995,075 | 11/1976 | Cernauskas | 427/239 |
| 4,384,657 | 5/1983 | Veno et al. | 427/239 |
| 4,886,013 | 12/1989 | Turner et al. | 118/668 |

FOREIGN PATENT DOCUMENTS

| | | |
|---|---|---|
| 6116537 | 1/1986 | Japan . |
| 1438108 | 9/1989 | Japan . |

OTHER PUBLICATIONS

Nordson Corporation Technical Publication 4–4–7, Issued Jan. 1984.

*Primary Examiner*—Janyce Bell
*Attorney, Agent, or Firm*—Tarolli, Sundheim & Covell

[57] ABSTRACT

An apparatus for applying coating material to inner surfaces of cans includes a coating material spray gun and a cleaning material spray gun which are mounted in a side-by-side relationship on a manifold block. The coating material spray gun is connected in fluid communication with a coating material supply conduit through the manifold block. The cleaning material spray gun is connected in fluid communication with a cleaning material supply conduit through the manifold block. The cleaning material spray gun is operable to direct a flow of cleaning material toward a nozzle on the coating material spray gun to clean the nozzle. Three point mounting systems are utilized to accurately mount the spray guns on the manifold block. A heater is provided to maintain body of coating material in the coating material spray gun at a desired temperature. A transducer is provided to sense changes in the pressure of the coating material during operation of the coating material spray gun from a closed condition to an open condition. Cleaning material is conducted through the coating material spray gun to clean an interior portion of the coating material spray gun. The operating stroke of valve assemblies in the coating material spray gun and the cleaning spray gun are set by utilizing shims having thicknesses corresponding to the desired operating strokes of the valve assemblies.

23 Claims, 12 Drawing Sheets

APPARATUS AND METHOD FOR APPLYING COATING MATERIAL

This is a divisional application Ser. No. 07/859,343, filed Mar. 27, 1992, now U.S. Pat. No. 5,296,035 and entitled Apparatus and Method for Applying Coating Material. The benefit of the earlier filing date of the aforesaid application Ser. No. 07/859,343, now U.S. Pat. No. 5,296,035 is hereby claimed.

BACKGROUND OF THE INVENTION

An improved apparatus and method are provided to apply coating material to at least portions of the inner surfaces of cans.

The insides of cans have previously been at least partially coated to ensure that material forming the cans is not exposed to the contents of the cans. Various apparatus for use in applying coating material to the insides of cans is disclosed in U.S. Pat. Nos. 3,726,711; 4,378,386; and 4,886,013.

During the operation of a can coating apparatus, particles of coating material tend to build up on the nozzle of a spray gun. Japanese Patent No. 1,438,108 suggests that a solvent spray may be directed against the nozzle of the spray gun to wash away the coating material which adheres to the nozzle.

During operation of the can coating apparatus, the flow of coating material from the spray gun may be shut off for a period of time. While the spray gun is shut off, the material spray gun prevents cooling of the coating material in the spray gun, by continuously circulating the coating material through the spray gun. It has been suggested that the coating material in a spray gun be heated by also conducting a secondary flow of heated coating material through the spray gun in the manner disclosed in Japanese Patent Application No. 61-16537.

SUMMARY OF THE INVENTION

The present invention provides a new and improved apparatus and method for use in applying coating material to at least a portion of an inner surface of a can. A coating material spray gun is connected with a manifold block and is operable to direct a flow of coating material toward the inner surface of the can. A cleaning material spray gun is also connected with the manifold block and is operable to direct a flow of cleaning material toward a nozzle of the coating material spray gun. The coating material spray gun and the cleaning material spray gun are accurately positioned relative to each other and the manifold block by using at least three positioning elements for each of the spray guns. A flow of cleaning material is conducted through the coating material spray gun to clean at least a portion of the coating material spray gun.

The coating material spray gun includes a heater which heats coating material in the coating material spray gun. The heater conducts a heating medium along a chamber in which a stagnant body of coating material is held when the coating material spray gun is in an inactive condition. The heating medium is preferably heated coating material.

During operation of the coating material spray gun between inactive and active conditions fluid pressure in a passage through which the coating material flows will vary. A transducer is exposed to the fluid pressure in the passage to sense changes in the pressure. The transducer is isolated from coating material conducted through the heater by a restrictor.

A valve assembly in either the coating material spray gun or the cleaning material spray gun can be adjusted so that a valve member moves through a predetermined distance between open and closed positions. During adjusting of the distance through which the valve member moves, a spacer member is placed between a surface connected with the valve member and a surface connected with a housing. After the valve member has been adjusted to press the spacer member against the surface connected with the housing, the spacer member is removed.

BRIEF DESCRIPTION OF THE DRAWINGS

The foregoing and other features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
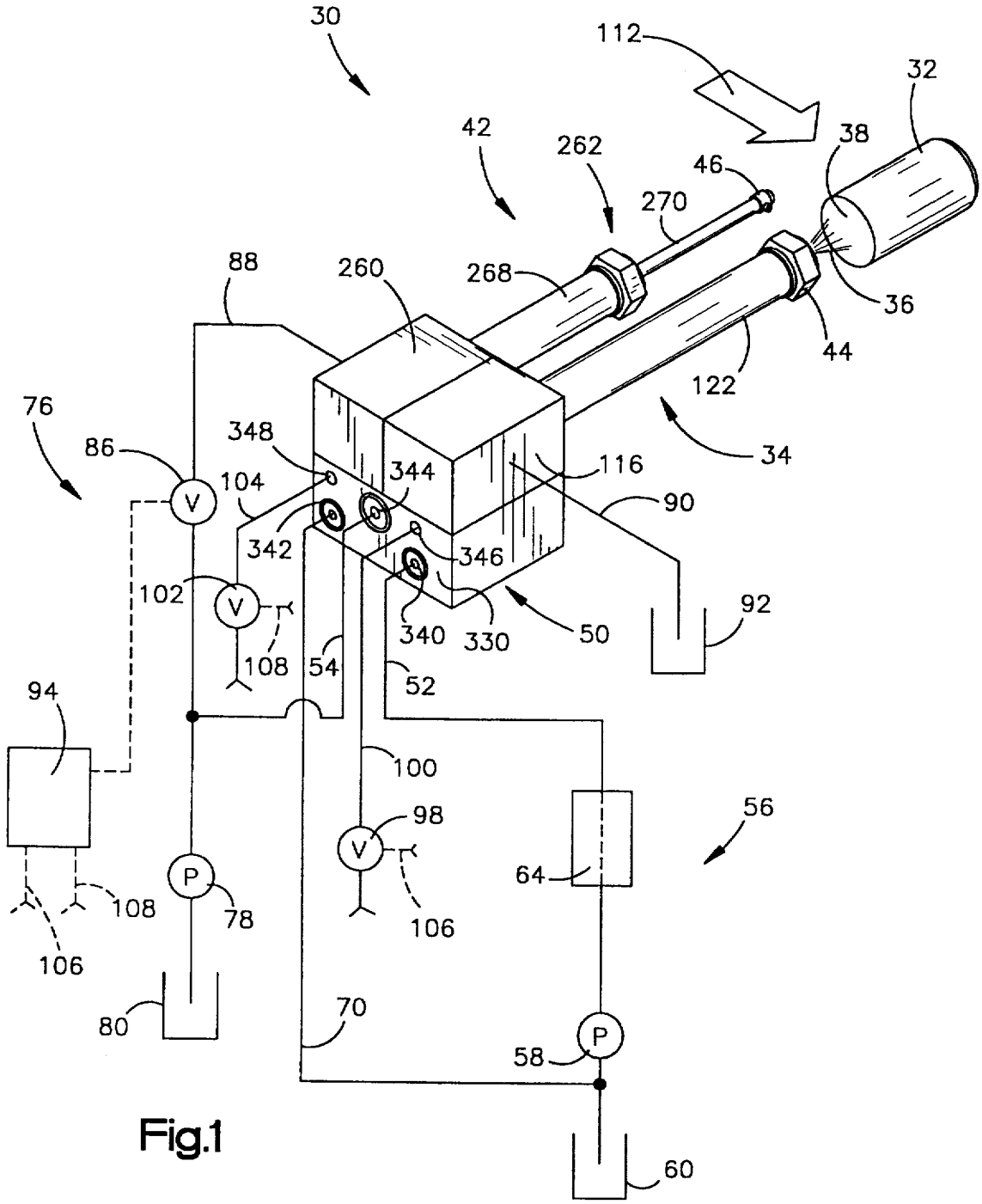
FIG. 1 is a schematic illustration of an apparatus constructed and operated in accordance with the present invention to apply coating material to at least a portion of an inner surface of a can.

An apparatus 30 for use in applying coating material to at least a portion of an inner surface of a can 32 is illustrated schematically in FIG. 1. The apparatus 30 includes a coating material spray gun 34 (FIGS. 1–4) which directs a flow 36 of coating material against at least a portion of the inside 38 of the can 32. A cleaning material spray gun 42 is operable to direct a flow of cleaning material against the outer end portion 44 of the coating material spray gun. The flow of cleaning material from an outer end portion 46 of the cleaning material spray gun 42, is effective to wash accumulated coating material off of the outer end portion 44 of the coating material spray gun.

Figure 3:
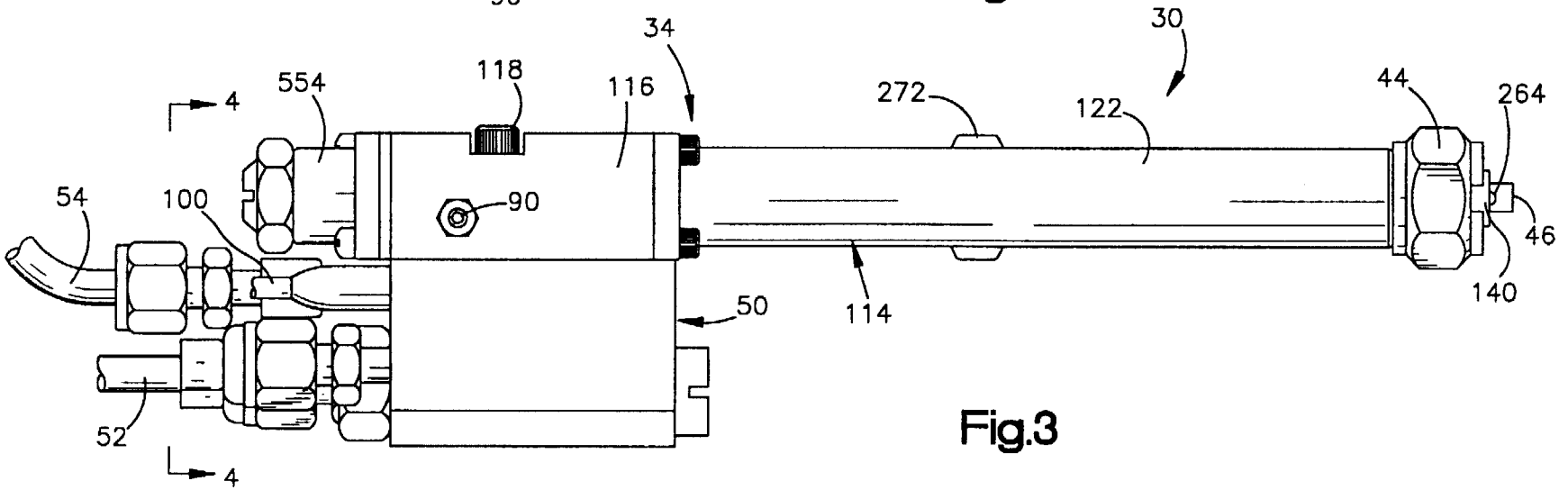
FIG. 3 is a side elevational view, taken generally along the line 3—3 of FIG. 2, illustrating the relationship of the coating material spray gun to a manifold block.
Figure 4:
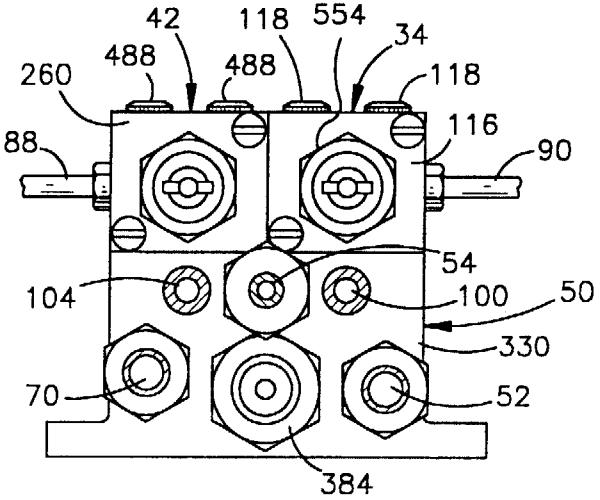
FIG. 4 is a rear end view, taken generally along the line 4—4 of FIG. 3, illustrating the relationship of the cleaning material spray gun and coating material spray gun to the manifold block.

The coating material spray gun 34 and cleaning material spray gun 42 are mounted in a side-by-side relationship on a manifold block 50 (FIGS. 1 and 4). A coating material supply conduit 52 (FIGS. 1–4) is connected with the manifold block 50. In addition, a main cleaning material supply conduit 54 is connected with the manifold block 50. The coating material spray gun 34 is connected in fluid communication with the coating material supply conduit 52 through the manifold block 50. Similarly, the cleaning material spray gun 42 is connected in fluid communication with a main cleaning material supply conduit 54 through the manifold block 50.

During the application of coating material to the inside 38 (FIG. 1) of the can 32, the liquid coating material may be at a temperature of approximately 115° F. and may be applied at a pressure of approximately 850 pounds per square inch. The manner in which the coating material is applied and the composition of the coating material may be similar to that disclosed in U.S. Pat. No. 4,378,386 issued Mar. 29, 1983 and entitled "Method of Spraying Closed End Cans". Of course, different coating materials can be applied at different temperatures and pressures to the inside of the can 32.

When water-based coating materials are applied to the inside of a can 32, the cleaning material dispensed by the cleaning material spray gun 42 will be primarily water. When solvent-based coating materials are applied to the inside of the can 32, the cleaning material dispensed by the cleaning material spray gun 42 will be primarily solvent.

Figure 2:
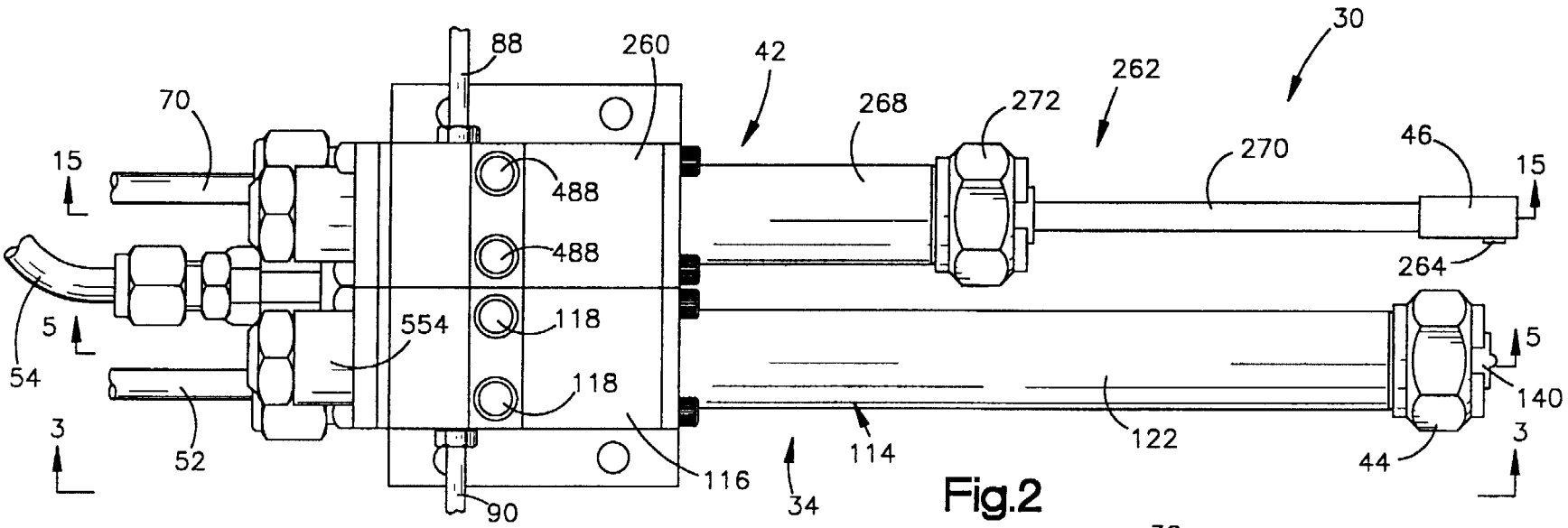
FIG. 2 is a top plan view illustrating the relationship between a coating material spray gun and a cleaning material spray gun of the apparatus of FIG. 1.

By having the coating material spray gun 34 extend outwardly from the manifold block 50 in the manner shown in FIGS. 1–3, the outer end portion 44 of the coating material spray gun can be readily positioned relative to a can 32. By having the cleaning material spray gun 42 extend outwardly from the manifold block 50, a flow of cleaning material can be readily directed from the outer end portion 46 of the cleaning material spray gun toward the outer end portion 44 of the coating material spray gun 34. Since the coating material supply conduit 52 and main cleaning material supply conduit 54 are connected to the manifold block 50, the cleaning material spray gun 34 and coating material spray gun 42 can be readily removed from the manifold block 54 for servicing or replacement without disturbing the connections between the manifold block and the supply conduits.

A coating material handling apparatus 56 (FIG. 1) controls the supply of coating material to the coating material spray gun 34 and the operation of the coating material spray gun. The coating material handling apparatus 56 includes a pump 58 which continuously pumps liquid coating material from a reservoir or container 60. The coating material flows from the pump 58 to an in-line heater 64. The in-line heater 64 heats the coating material to a desired temperature, approximately 115° F. Of course, the specific temperature to which the coating material is heated by the in-line heater 64 will depend upon the composition and characteristics of the coating material. The heater 64 has a thermostat to enable the temperature of the coating material to be adjusted.

The hot coating material flows from the in-line heater 64 through the coating material supply conduit 52 to the manifold block 50. The heated coating material flows from the manifold block 50 to the coating material spray gun 34. The coating material spray gun 34 is operable to spray the hot coating material inside the can 32.

A return flow of coating material is conducted back to the inlet to the pump 58 from the coating material spray gun 34 through the manifold block 50 and a coating material return conduit 70 (FIG. 1). The coating material which is returned through the conduit 70 is again pumped through the in-line heater 64 and returned to the manifold block 50 and coating material spray gun 34. Thus, there is a continuous circulation of coating material through the manifold block 50 and coating material spray gun 34.

The pump 58 is commercially available from Nordson

Corporation of Westlake, Ohio under the designation of Model CP. The heater. 64 is commercially available from Nordson Corporation of Westlake, Ohio under the designation of Model NH4. Of course, other known pumps and heaters could be used for the pump 58 and heater 64.

A cleaning material handling apparatus 76 (FIG. 1) controls the supply of cleaning material to the cleaning material spray gun 42 and the operation of the cleaning material spray gun. The cleaning material handling apparatus 76 includes a pump 78 which continuously pumps liquid cleaning material from a reservoir or container 80. The cleaning material is conducted through the main cleaning material supply conduit 54 and the manifold block 50. The cleaning material spray gun 42 is connected in fluid communication with the main cleaning material supply conduit 54 through the manifold block 50. The cleaning material is sprayed against the outer end portion 44 of the coating material spray gun 34 by the cleaning material spray gun 42 when the coating material spray gun is inactive, that is, when a flow of coating material is not being directed toward the inside 38 of a can 32.

A secondary flow of cleaning material flows from the pump 78 to a flow control valve 86. When the flow control valve 86 is open, the cleaning material flows to a secondary cleaning material supply conduit 88. The flow control valve 86 reduces the fluid pressure in the cleaning material conducted through the flow control valve. The cleaning material flows from the secondary cleaning material supply conduit 88 through the cleaning material spray gun 42 and through the coating material spray gun 34 to a drain conduit 90 and reservoir 92. As the cleaning material passes through the coating material spray gun 34, the cleaning material cleans a portion of the coating material spray gun.

Although it is preferred to provide a secondary cleaning material conduit 88 to conduct a flow of cleaning material to clean the coating material spray gun 34, the flow of cleaning material to clean the coating material spray gun 34 could be conducted from the manifold block 50 if desired. If the cleaning material is conducted from the manifold block 50 to the coating material spray gun 34 to clean the coating material spray gun, the secondary cleaning material supply conduit 88 and associated flow control valve 86 may be eliminated. A controller 94 is provided to control the operation of the flow control valve 86. If the fluid pressure at the outlet of the pump 78 exceeds a predetermined pressure, a pneumatic motor (not shown) for the pump stalls.

The coating material spray gun 34 (FIG. 1) is operable between an inactive condition in which a flow of coating material from the spray gun is blocked and an active condition in which a flow 36 of coating material is directed from the coating material spray gun 34 toward the inside 38 of the can 32. Similarly, the cleaning material spray gun 42 is operable between an inactive condition in which a flow of cleaning material from the spray gun is blocked and an active condition in which a flow of cleaning material is directed from the outer end portion 46 of the cleaning material spray gun 42 against the outer end portion 44 of the coating material spray gun 34.

In the illustrated embodiment of the invention, the cleaning material spray gun 34 and coating material spray gun 42 are operated between the active and inactive conditions under the influence of control fluid pressure. Thus, when a control valve 98 (FIG. 1) is in an open condition, air under pressure is conducted to the coating material spray gun 34 through the conduit 100 and the manifold block 50. The control fluid (air) pressure operates the coating material spray gun 34 from the inactive condition to the active condition in which the flow 36 of coating material is directed toward the inside 38 of the can 32. When the control valve 98 is actuated to a closed condition, the conduit 100 and the coating material spray gun 34 are vented to atmosphere. The coating material spray gun 34 then becomes inactive, that is, the flow 36 of coating material is interrupted.

When a control valve 102 (FIG. 1) is in an open condition, air under pressure is conducted to the cleaning material spray gun 42 through a conduit 104 and the manifold block 50. The control fluid (air) pressure operates the cleaning material spray gun 42 from the inactive condition to the active condition in which a flow of cleaning material is directed against the outer end portion 44 of the coating material spray gun 34. At this time, the coating material spray gun 34 will be in the inactive condition. When the control valve 102 is actuated to a closed condition, the conduit 104 and the cleaning material spray gun 42 are vented to atmosphere. When the cleaning material spray gun 42 is vented to atmosphere, the cleaning material spray gun becomes inactive, that is, the flow of cleaning material is interrupted.

Operation of the control valves 98 and 102 is controlled by the controller 94. Thus, the solenoid actuated control valves 98 and 102 are connected with the controller 94 over leads which have been indicated schematically at 106 and 108 in FIG. 1.

In the illustrated embodiment of the invention, the coating material spray gun 34 and cleaning material spray gun 42 are operated between the active and inactive conditions under the influence of control fluid (air) pressure. However, it is contemplated that the coating material spray gun 34 and cleaning material spray gun 42 could be operated between the active and inactive conditions in a different manner. For example, electrical solenoids could be utilized to operate the coating material spray gun 34 and cleaning material spray gun 42 between the active and inactive conditions. If this was done, the control valves 98 and 102 and conduits 100 and 104 would be eliminated.

During operation of the apparatus 30, cans 32 sequentially move past the outer end portions 44 and 46 of the coating material spray gun 34 and cleaning material spray gun 42 along a path indicated by an arrow 112 in FIG. 1. As each of the cans 32 moves past the coating material spray gun 34, a coating is applied to at least a portion of the inside 38 of the can. Although the rate at which the cans 32 are coated may vary, it is contemplated that the cans will be coated at a rate of approximately 700 to 750 cans per minute.

Pump 58 pumps continuously to pump coating material through the in-line heater 64. The hot coating material is conducted from the in-line heater 64 to the coating material supply conduit 52 and manifold block 50. A flow of the hot coating material is conducted through the manifold block 50 to the coating material spray gun 34. A flow of coating material is returned from the coating material spray gun 34 through the manifold block 50 and the conduit 70 to the inlet to the pump 58. A restrictor (not shown) can be provided in line 70 to control the flow rate of material returned from the spray gun.

As soon as a can 32 has moved into alignment with the outer end portion 44 of the coating material spray gun 34, the controller 94 effects operation of the control valve 98 from the closed condition to the open condition. Control fluid (air) pressure is then conducted through the conduit 100 and manifold block 50 to the coating material spray gun 34. The control fluid pressure effects operation of the coating material spray gun 34 from the inactive condition to the active condition. As soon as the coating material spray gun 34 is operated to the active condition, a flow 36 of heated coating material is directed toward the inside 38 of the can 32.

When the desired amount of coating material has been applied to the inside of the can 32, the controller 94 effects operation of the control valve 98 from the open condition to the closed condition. This vents the coating material spray gun 34 to atmosphere. Venting of the coating material spray gun 34 effects operation of the coating material spray gun to the inactive condition. While the coating material spray gun 34 is in the inactive condition, a coated can 32 is moved away from the coating material spray gun and the next succeeding can is moved along the path 112 into alignment with the coating material spray gun.

After a plurality of cans 32 have been coated, coating material will have accumulated on the outer end portion 44 of the coating material spray gun 34. Pump 78 is continuously operating and supplies pressurized cleaning fluid to the cleaning gun.

As soon as the coating material spray gun 34 has been operated to the inactive condition, the control valve 102 is operated to the open condition by the controller 94. This results in air pressure being directed through the conduit 104 and the manifold block 50 to the cleaning material spray gun 42. The air pressure conducted from the manifold block 50 to the cleaning material spray gun 42 operates the cleaning material spray gun from the inactive condition to the active condition. A flow of cleaning material from the outer end portion 46 of the cleaning material spray gun 42 is directed toward the outer end portion 44 of the coating material spray gun 34.

After the flow of cleaning material has been of sufficient duration to wash the accumulated coating material off of the outer end portion 44 of the coating material spray gun 34, the controller 94 effects operation of the control valve 102 to the closed condition. This vents the cleaning material spray gun 42 to atmosphere through the manifold 50 and valve 102. Venting of the cleaning material spray gun 42 effects operation of the cleaning material spray gun to the inactive condition. Operation of the coating material spray gun 34 to coat the inside of cans 32 is then resumed.

Periodically during the operation of the coating material spray gun 34, the controller 94 will actuate the cleaning material flow control valve 86 to an open condition enabling cleaning material to flow, at a relatively low pressure, through the secondary cleaning material supply conduit 88. The flow of cleaning material is conducted from the secondary cleaning material supply conduit 88 through the cleaning material spray gun 42 and coating material spray gun 34 to the drain conduit 90. The flow of cleaning material through the coating material spray gun 34 cleans a portion of the coating material spray gun. The cleaning of the coating material spray gun 34 by a flow of cleaning material through the spray gun may be performed when the coating material spray gun 34 is in either active condition or the inactive condition.

Coating Material Spray Gun

The coating material spray gun 34 includes a housing 114 having a rectangular body section 116 (FIGS. 2–6) which is connected with the manifold 50 by bolts 118. The body section 116 of the coating material spray gun 34 is connected in fluid communication with the coating material supply conduit 52 (FIGS. 1 and 4) and the control fluid pressure conduit 100 through the manifold block 50. The housing 114 has a generally cylindrical extension section 122 (FIGS. 2, 3 and 5) which is connected to and extends outwardly from the body section 116.

Heated coating material under pressure is conducted from the manifold block 50 (FIGS. 3 and 4) to an elongated cylindrical chamber 126 (FIG. 5) in the coating material spray gun 34. The chamber 126 extends from the body section 116 to the outer end portion 44 of the extension section 122. The chamber 126 has an inlet end portion 128 disposed in the body section 116 and an outlet end portion 130 disposed at the outer end portion of the extension section 122.

A coating material inlet passage 132 is formed in a hollow positioning pin 134. Hot coating material under pressure flows through the passage 132 in the positioning pin 134 into the inlet end portion 128 of the chamber 126. The hot coating material then flows to the outlet end portion 130 of the chamber 126.

A valve assembly 138 (FIG. 5) is provided in the outer end portion 44 of the coating material spray gun 34 to control the flow of heated coating material from the chamber 126 through a nozzle 140. The valve assembly 138 includes a stationary valve seat 144 and a movable valve member 146. The movable valve member 146 has a generally spherical head end portion 148 which engages the valve seat 144 to block fluid flow through a passage 150 in the valve seat.

When the head end portion 148 of the valve member 146 is in an open position spaced from the valve seat 144, hot coating material can flow in a stream from the chamber 126 through the passage 150 in the valve seat to the nozzle 140. The nozzle 140 has a central passage 154 through which a flow of hot coating material is directed toward a can 32 when the valve assembly 138 is in the open condition. When the valve assembly 138 is in the closed condition, flow of coating material to the nozzle 140 is blocked. Blocking the flow of coating material to the nozzle 140 interrupts the stream of coating material flowing from the chamber 126 and the coating material in the chamber becomes stagnant.

A solid cylindrical metal valve actuator rod 158 is connected with the valve member 146 and extends through the chamber 126 to a valve actuator assembly 162. The valve actuator rod 158 has a longitudinal central axis which is coincident with a longitudinal central axis of the chamber 126. An annular seal 164 engages the valve actuator rod 158 to block a flow of coating material from the chamber 126 axially along the valve actuator rod.

During a coating operation, the valve actuator assembly 162 moves the valve actuator rod 158 toward the left (as viewed in FIG. 5) to move the valve member 146 away from the valve seat 144. As the head end portion 148 of the valve member 146 moves out of engagement with the valve seat 144, heated coating material under pressure begins to flow from the chamber 126 through the nozzle 140. The nozzle 140 directs a flow of coating material which has been heated by the in-line heater 64 (FIG. 1) and pressurized by the pump 58, toward the inside 38 of a can 32. As the coating material flows through the valve assembly 138 (FIG. 5) and the nozzle 140 toward the inside of a can, hot coating material is pumped into the chamber 126 through the manifold block 50 and inlet passage 132 in the positioning pin 134.

Figure 5:
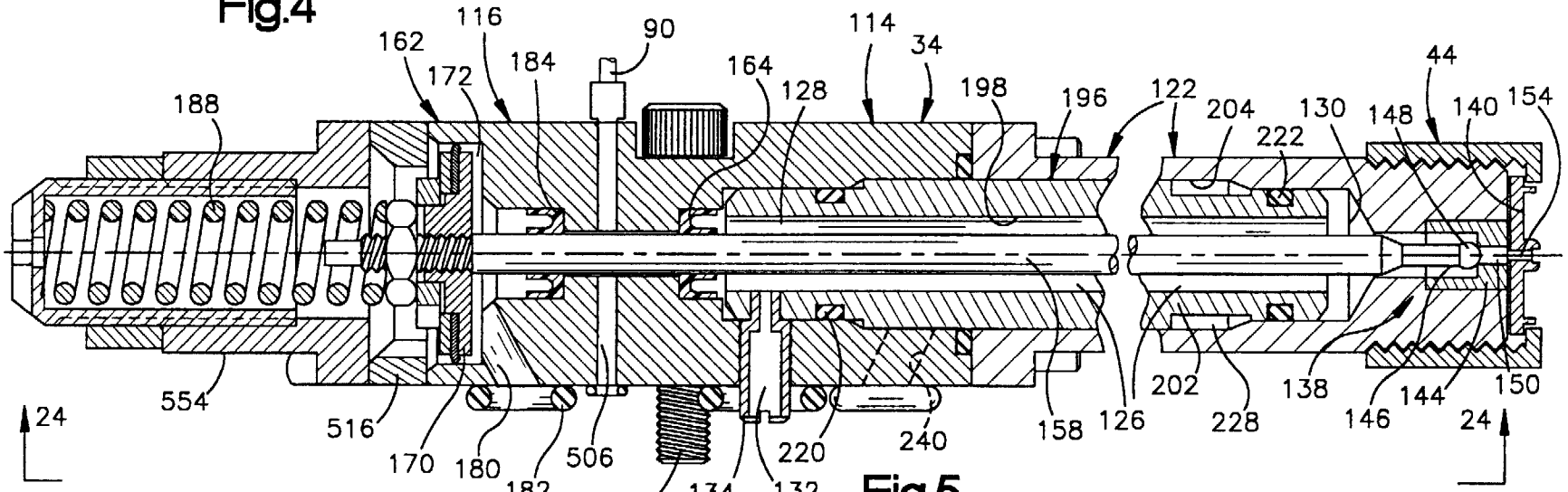
FIG. 5 is a partially broken away sectional view, taken on an enlarged scale along the line 5—5 of FIG. 2, illustrating the construction of the coating material spray gun.

When the valve assembly 138 (FIG. 5) has been in the open condition for a sufficient length of time to coat the inside of a can, the valve actuator assembly 162 moves the valve actuator rod 158 axially toward the right (as viewed in FIG. 5). This operates the valve assembly 138 to the closed condition and blocks the flow of coating material from the chamber 126. Blocking the flow of coating material from the chamber 126 causes the coating material in the chamber to stagnate.

Figure 11:
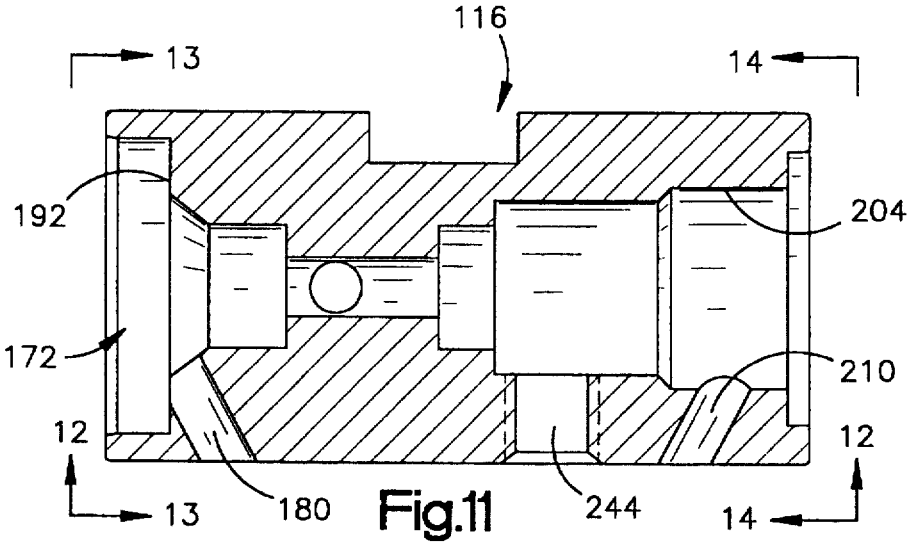
FIG. 11 is a sectional view, taken generally along the line 11—11 of FIG. 12, of a body section of the coating material spray gun.
Figure 12:
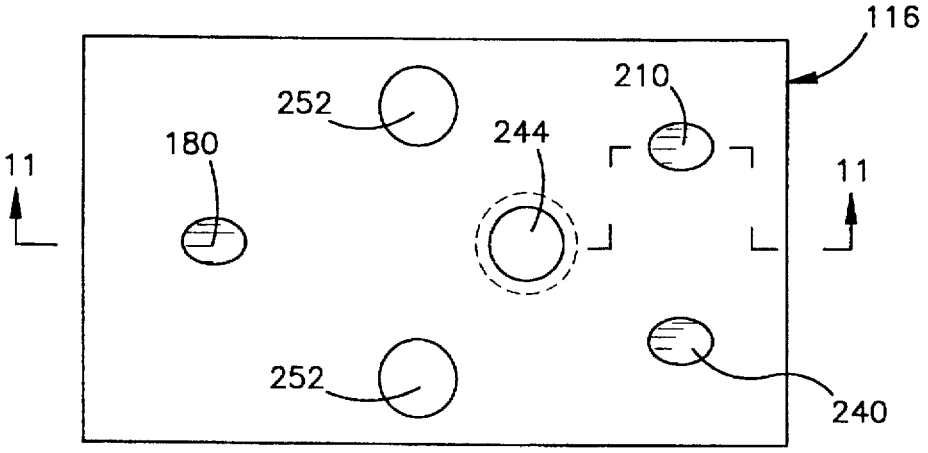
FIG. 12 is a bottom plan view, taken generally along the line 12—12 of FIG. 11, further illustrating the construction of the body section of the coating material spray gun.
Figure 13:
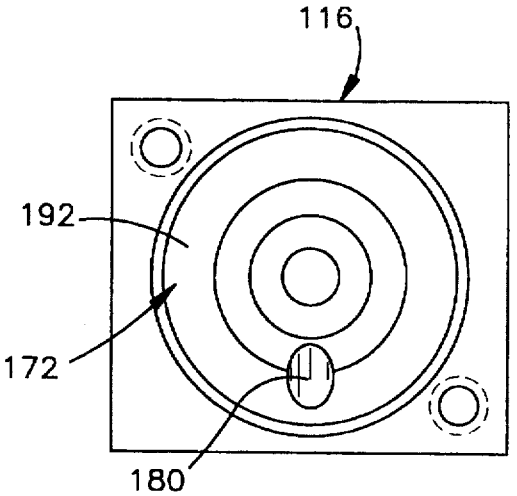
FIG. 13 is an end view, taken generally along the line 13—13 of FIG. 11, illustrating an actuator cylinder chamber.

The valve actuator assembly 162 includes a circular piston 170 (FIG. 6) having internal threads which engage external threads on the valve actuator rod 158. The piston 170 is disposed in a cylindrical chamber 172 (FIGS. 6, 11 and 13) in the body section 116. An annular seal 174 (FIG. 6) extends radially outwardly from the piston 170 into sealing engagement with a cylindrical side wall of the piston chamber 172. Although many different types of seals could be utilized, it is presently preferred to utilize a "RULON" seal which is commercially available from Dixon Industries Corporation having a place of business at Bristol, R.I. It is believed that "RULON" is polytetrafluoroethylene.

The piston chamber 172 is connected in fluid communication with the control fluid (air) pressure supply conduit 100 (FIG. 1) through the manifold block 50 and a passage 180 (FIGS. 6 and 11–13) formed in the body section 116 of the coating material spray gun 34. A seal ring 182 (FIG. 6) is provided between the manifold block 50 and the body section 116 to prevent leakage of control fluid pressure between the body section and the manifold block. An annular seal 184 disposed in the piston chamber 172 engages the valve actuator rod 158 to prevent a leakage of control fluid pressure along the valve actuator rod.

The piston 170 is urged toward the right (as viewed in FIG. 6) end of the piston chamber 172 by a helical biasing spring 188. However, engagement of the valve member 146 (FIG. 5) with the valve seat 144 prevents the piston 170 from moving into abutting engagement with a flat annular end surface 192 (FIGS. 6 and 11) of the piston chamber 172. Thus, when the valve member 146 is in the closed position of FIG. 5, the valve actuator rod 158 holds the piston 170 spaced from the end surface 192 (FIG. 6) of the piston chamber 172. Therefore, the valve member 146 (FIG. 5) is urged toward the closed condition under the influence of force transmitted through the valve actuator rod 158 from the biasing spring 188.

Upon operation of the control valve 98 (FIG. 1) to the open condition by the controller 94, air under pressure is conducted through the conduit 100 to the manifold block 50. The air pressure is conducted from the manifold block 50 through the passage 180 (FIG. 6) to the piston chamber 172. The air pressure in the chamber 172 is applied against the right (as viewed in FIG. 6) end face of the piston 170.

The air pressure applied against the piston 170 moves the piston and valve actuator rod 158 toward the left (as viewed in FIG. 6) against the influence of the biasing spring 188. As the piston 170 and valve member 158 move against the influence of the biasing spring 188, the head end portion 148 (FIG. 5) of the valve member 146 moves away from the valve seat 144. The hot coating material which is held under pressure in the chamber 126 can then flow through the valve assembly 138 and nozzle 140. The nozzle 140 directs the flow of coating material toward the inside 38 of the can 32 (FIG. 1).

After the inside of the can 32 has been coated, the controller 94 (FIG. 1) operates the control valve 98 to the closed condition. When the control valve 98 is closed, the conduit 100 is vented to atmosphere. This results in the piston chamber 172 (FIG. 5) being vented to atmosphere through the passage 180 and the manifold block 50. Upon venting of the piston chamber 172 to atmosphere, the biasing spring 188 moves the piston 170 and valve actuator rod 158 toward the right (as viewed in FIG. 5). This moves the head end portion 148 of the valve member 146 into engagement with the valve seat 144 to block the flow of coating material from the chamber 126.

The coating material spray gun 34 advantageously includes a heater assembly 196 (FIG. 5) which heats the coating material in the chamber, 126 to maintain the coating material at a desired temperature. The heater assembly 196 extends from the body section 116 of the coating material spray gun 34 to the outer end portion 44 of the coating material spray gun. The heater assembly 196 is disposed between the valve assembly 138 and the actuator assembly 162.

To promote the transfer of heat from the heater assembly 196 to the coating material in the chamber 126, the heater assembly is coextensive with the chamber. Thus, the heater assembly 196 extends from a location adjacent to the inlet end portion 128 of the chamber 126 to a location adjacent to the outlet end portion 130 of the chamber. The heater assembly 196 extends around the chamber 126 and has a cylindrical inner side surface 198 which forms an outer side surface of the chamber. The longitudinal central axis of the inner side surface 198 of the heater assembly 196 is coincident with the longitudinal central axes of the valve actuator rod 158 and the chamber 126.

Figure 14:
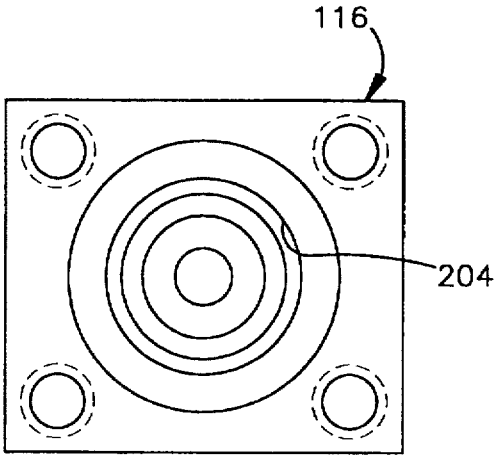
FIG. 14 is an end view, taken generally along the line 14—14 of FIG. 11, illustrating a chamber in which an end portion of the heater body of FIGS. 7—10 is received.

The heater assembly 196 includes a generally cylindrical heater body 202 (FIGS. 5 and 7–10) which is formed from a single piece of metal. The outside of the cylindrical heater body engages a cylindrical inner surface 204 (FIGS. 11 and 14) formed on the body section 116 and extension section 122 (FIGS. 5 and 6) of the coating material spray gun 34. The cylindrical outer side of the heater body 202 cooperates with the cylindrical surface 204 to define a plurality of passages through which a heating medium flows.

The heater body 202 is formed of metal so that heat is readily conducted from the passages formed in the heater body to the body of coating material in the longitudinally extending chamber 126. Since the heater body 202 extends for substantially the entire length of the chamber 126, all of the coating material in the chamber is heated by the heating medium which is conducted through the passages formed in the heater body.

A heating medium inlet passage 210 (FIGS. 11, 12, and 24) is formed in the body section 116 of the coating material spray gun 34. The heating medium is conducted from the manifold block 50 to the passage 210. An O-ring seal 212 (FIG. 24) is provided to prevent a leakage of the heating medium between the body section 116 of the coating material spray gun 34 and the manifold block 50.

Figure 7:
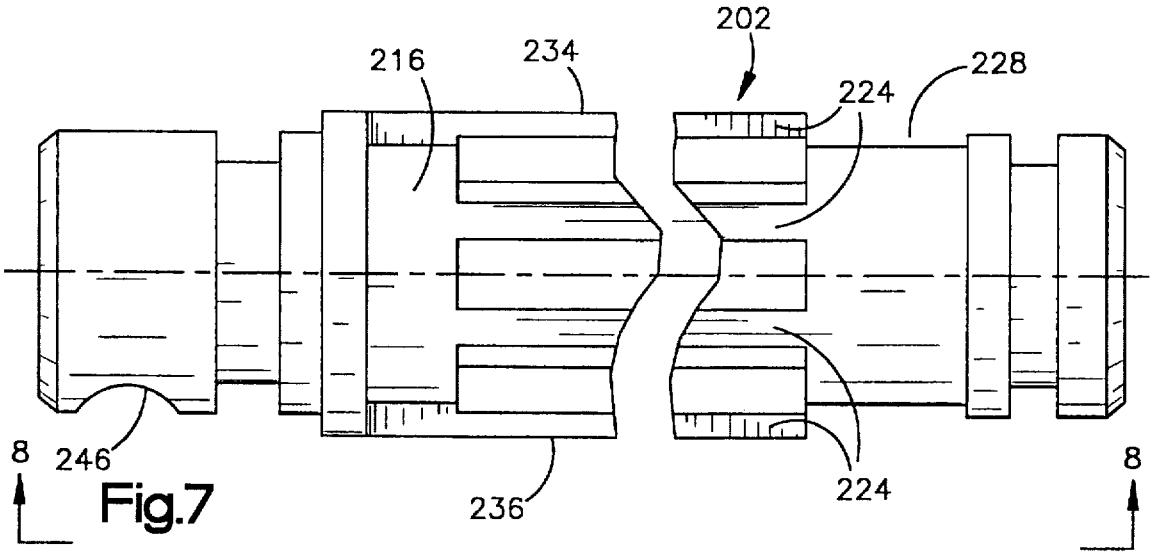
FIG. 7 is a partially broken away side elevational view of a heater body used in the coating material spray gun of FIG. 5.
Figure 8:
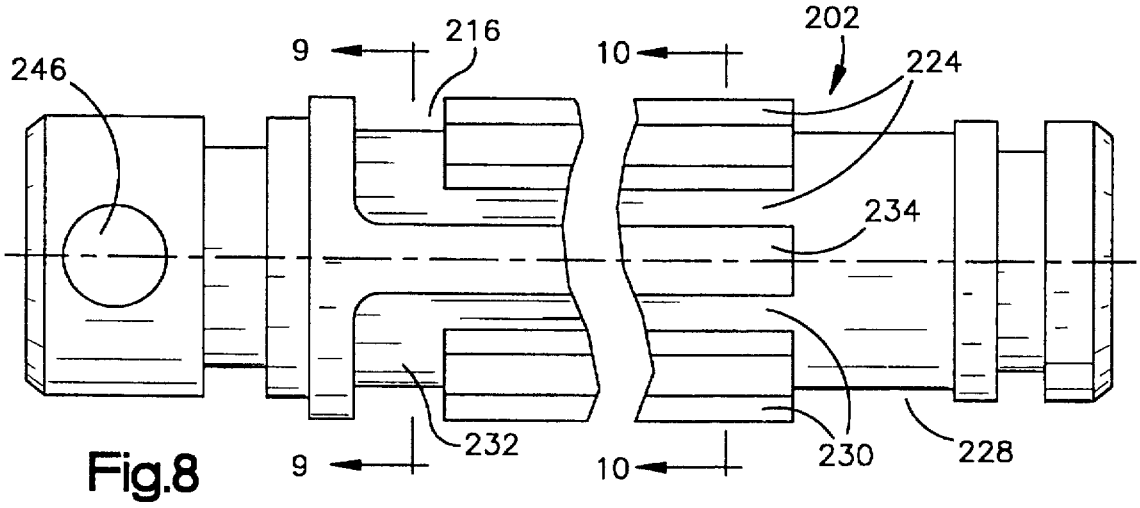
FIG. 8 is a bottom plan view of the heater body, taken along the line 8—8 of FIG. 7.
Figure 9:
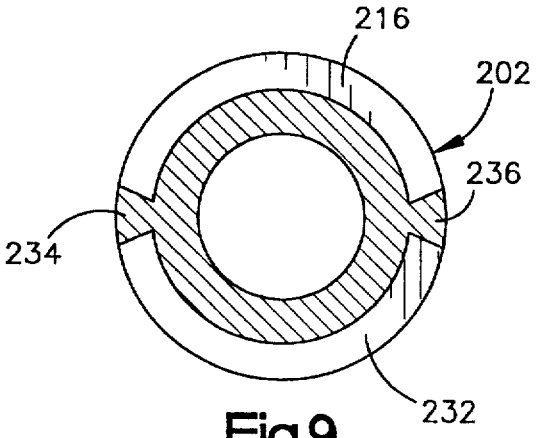
FIG. 9 is a sectional view, taken generally along the line 9—9 of FIG. 8, illustrating the construction of inlet and outlet manifold passages through which a heating medium flows.

The heating medium flows from the inlet passage 210 into an arcuate inlet manifold passage 216 (FIGS. 7–9). The inlet manifold passage 216 is formed between the heater body 202 and the body section 116 of the coating material spray gun 34. The inlet manifold passage 216 has a generally semi-circular configuration (FIGS. 7–9) and is disposed at an inner end portion of the heater body 202.

The heating medium contained in the inlet passage 210 and the inlet manifold passage 216 is maintained separate from the coating material contained in the inlet passage 132 and the chamber 126. An O-ring seal 220 (FIGS. 5 and 6) is provided between the heater body 202 and the body section 116 of the coating material spray gun 34 to block a flow of heating medium axially along the heater body 202 from the inlet manifold passage 216 (FIG. 7). In addition, the O-ring seal 220 blocks a flow of coating material from the chamber 126 along a path between the heater body 202 and the body section 116 of the coating material spray gun 34. Likewise, an O-ring seal 222 (FIG. 5) blocks the flow of coating material from chamber 126 along the path between heater body 202 and an extension section 122. By conducting the coating material into the chamber 126 through the hollow positioning pin 134, the possibility of leakage between the chamber 126 and the heating medium inlet manifold passage 216 is further minimized.

The heating medium flows from the inlet manifold passage 216 into linear passages 224 (FIGS. 7, 8 and 10) which extend axially along the heater body 202. The heating medium flows axially along the passages 224 to an annular manifold chamber 228 formed between the outer end portion of the heater body 202 and the extension section 122. The annular manifold chamber 228 extends around the heater body 202 and the chamber 126.

The combined axial extent of the inlet manifold passage 216, heater medium passages 224 and the manifold chamber 228 is substantially the same as the length of the chamber 126 in which a stagnant body of coating material is held when the valve assembly 138 is in the closed condition. Therefore, heat can be readily transferred from the heating medium disposed in the manifold inlet passage 216, axially extending passages 224 and manifold chamber 228 to the coating material disposed in the chamber 126. The heater body 202 extends axially in opposite directions past the inlet manifold passage 216 and annular manifold chamber 228 (FIG. 5) to enable heat to be conducted through the metal heater body to opposite end portions 128 and 130 of the chamber 126.

The heating medium flows from the annular manifold chamber 228 along return passages 230 (FIGS. 8 and 10) to a semi-circular outlet manifold passage 232 (FIGS. 8 and 9). The inlet manifold passage 216 is separated from the outlet manifold passage 232 by a pair of axially extending linear ribs 234 and 236 (FIGS. 7–10) formed in the heater body 202. Of course, as the heating medium is conducted from the annular manifold chamber 228 through the return passages 230 to the outlet manifold chamber 232, heat is transferred from the heating medium to the coating material in the chamber 126. The heating medium is conducted from the outlet manifold passage 232 to the manifold block 50 through an outlet passage 240 (FIGS. 5, 6, 12 and 24) formed in, the body section 116 of the coating material spray gun.

Figure 10:
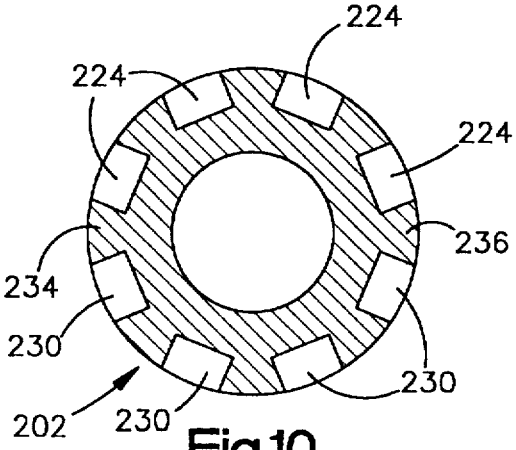
FIG. 10 is a sectional view, taken generally along the line 10—10 of FIG. 8, illustrating the relationship of a plurality of passages along which the heating medium flows between the inlet and outlet manifold passages.

The heating medium continuously circulates through the heater body 202. The heating medium flows axially along the heater body 202 in opposite directions. Thus, the heating medium flows axially outwardly along passages 224 formed in the upper side of the heater body 202 (FIGS. 8 and 10). The heating medium flows axially inwardly along return passages 230 formed in the lower side of the heater body 202.

The passages 224 and 230 on opposite sides of the heater body 202 are adjacent to the coating material in the chamber 126 (FIG. 5). Therefore, heat is transmitted from the heating medium in the passages 224 and 230 in the heater body 202 to the coating material in the chamber 126 to maintain the coating material at a desired temperature. Although the passages 224 and 230 have been illustrated as having a linear configuration and as being disposed on opposite sides of the heater body 202, the passages could have a helical configuration and extend around the heater body.

Although it is contemplated that many different types of liquids could be utilized as the heating medium which is conducted through the passages 224 and 230 in the heater body 202, it is preferred to use the coating material as the heating medium. This is because the coating material is heated by the in-line heater 64 (FIG. 1) and using the coating material as the heating medium eliminates the necessity of providing another heater. However, different heating mediums could be utilized if desired. In fact, it is contemplated that an electrical heater could be utilized to heat the body of coating material in the chamber 126. If the coating material does not have to be heated, the heater assembly 196 could be omitted from the coating material spray gun 34.

The body section 116 has a passage 244 (FIGS. 6, 11 and 12) in which the positioning pin 134 is received. The positioning pin 134 extends through a passage 246 (FIGS. 7 and 8) formed in the heater body 202. The mounting bolts 118 (FIG. 2) for securing the body section 116 to the manifold 50 extend through passages 252 (FIG. 12) formed in the body section 116. Although it is preferred to mount the coating material spray gun 34 on the manifold block 50 in a side-by-side relationship with the cleaning material spray gun 42, the coating material spray gun could be used without the manifold block and/or the cleaning material spray gun.

Cleaning Material Spray Gun

The cleaning material spray gun 42 (FIG. 15) directs a flow of cleaning material toward the nozzle 140 (FIG. 5) in 10 the outer end portion 44 of the coating material spray gun 34. The flow of cleaning material removes any build up of coating material on the nozzle 140 to prevent clogging of the nozzle during usage of the coating material spray gun 34. The construction and general mode of operation of the cleaning material spray gun 42 is similar to the construction and mode of operation of the coating material spray gun 34. However, the cleaning material spray gun 42 does not have a heater. This is because it is unnecessary to heat the cleaning material.

The cleaning material spray gun 42 includes a rectangular body section 260 (FIG. 15) which is mounted on the manifold block 50 in a side-by-side relationship with the body section 116 of the coating material spray gun 34 (FIGS. 2, 3 and 4). The body section 260 of the cleaning material spray gun 42 is connected in fluid communication with the main cleaning material supply conduit 54 (FIG. 1) and pump 78 through the manifold block 50.

The cleaning material supply gun 42 has an extension section 262 (FIGS. 2 and 15) which extends outwardly from the body section 260. The extension section 262 is connected to the body section 260 and extends outwardly from the body section to support a nozzle 264 (FIG. 2) on the outer end portion of the extension section 262. The nozzle 264 faces toward the outer end portion 44 of the coating material spray gun 34.

A flow of cleaning material from the nozzle 264 of the cleaning material spray gun 42 impinges against the nozzle 140 on the coating material spray gun 34 to clean the nozzle 140. In addition, the flow of cleaning material from the nozzle 264 of the cleaning material spray gun 42 impinges against the area around the nozzle 140 on the coating material spray gun 34. This enables the flow of cleaning material to wash away any accumulated coating material on the outer end portion 44 of the coating material spray gun 34.

The extension section 262 (FIG. 15) includes a cylindrical barrel section 268 and a smaller diameter cylindrical rod section 270. A connector assembly 272 is provided to connect the rod section 270 to the barrel section 268. The barrel and rod sections 268 and 270 have coincident central axes which extend parallel to a central axis of the extension section 122 (FIG. 2) of the coating material spray gun 34. It is contemplated that the rod section 270 could have a portion with a bent or offset configuration to position the nozzle 264 closer to the outer end portion 44 of the coating material spray gun 34.

Cleaning material under pressure is conducted from the manifold block 50 (FIG. 1) to an elongated and generally cylindrical chamber 276 (FIG. 15) in the cleaning material spray gun 42. The chamber 276 extends from the body section 260 of the cleaning material spray gun 42 to the outer end portion of the barrel section 268. Cleaning material is conducted to the chamber 276 through an inlet passage 278 formed in a positioning pin 280 connected with the body section 260. The cleaning material from the inlet passage 278 flows along the generally cylindrical chamber 276 to a valve assembly 282 disposed at the outer end portion of the barrel section 268.

When the valve assembly 282 is in an open condition, the cleaning material flows through a cylindrical chamber 284 in the rod section 270. The cleaning material flows from the rod section 270 through the nozzle 264 (FIG. 2) at the outer end portion 46 of the cleaning material spray gun 42. The cleaning material flows out of the nozzle 264 (FIG. 2) in a direction which is perpendicular to the longitudinal central axes of the barrel section 268 and rod section 270. The nozzle 264 directs the flow of cleaning material against the nozzle 140 in the coating material spray gun 34.

Figure 15:
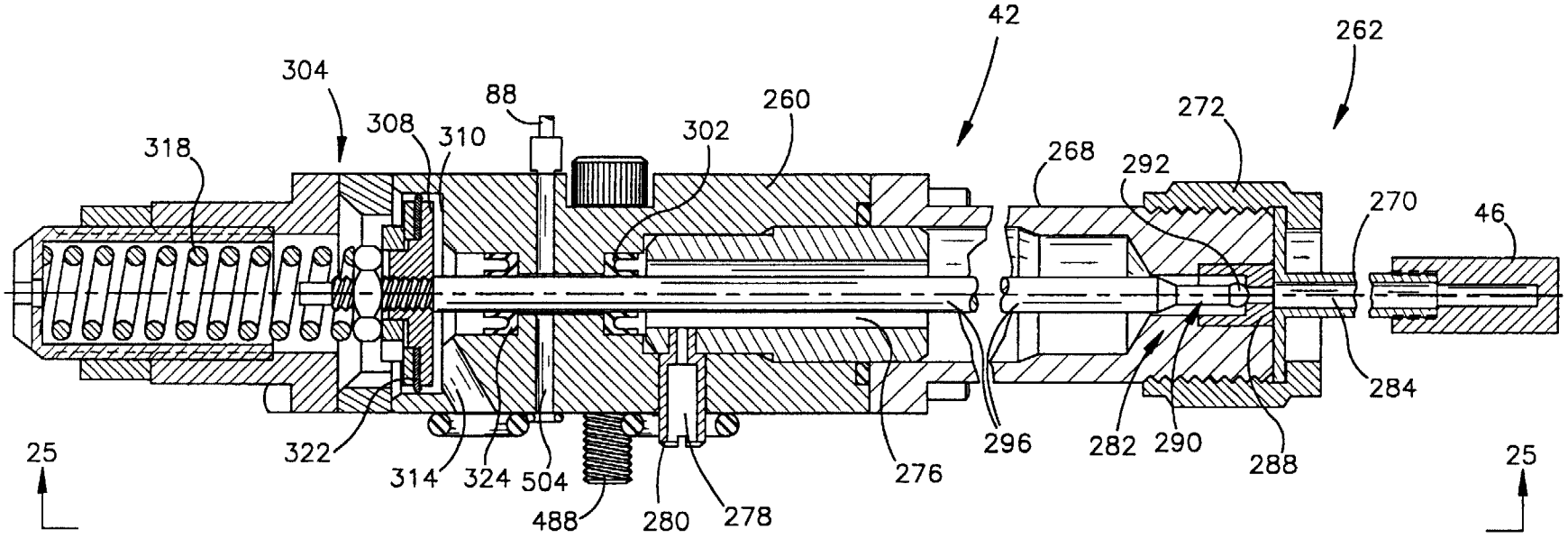
FIG. 15 is a partially broken away sectional view, taken generally along the line 15—15 of FIG. 2, illustrating the construction of the cleaning material spray gun.

The valve assembly 282 includes a stationary valve seat 288 (FIG. 15). The valve seat 288 is engaged by a movable valve member 290 having a generally spherical head end portion 292. The head end portion 292 of the valve member 290 engages the valve seat 288 to seal the chamber 276 and block the flow of cleaning material to the rod section 270.

A cylindrical valve actuator rod 296 is connected with the valve member 290 and extends through the chamber 276. The longitudinal central axis of the valve actuator rod 296 is coincident with the longitudinal central axis of the chamber 276. A seal 302 blocks a flow of cleaning material from the chamber 276 along the valve actuator rod 296.

A valve actuator assembly 304 is connected with the valve actuator rod 296. The valve actuator assembly 304 is operable to move the valve actuator rod 296. Movement of the valve actuator rod 296 actuates the valve assembly 282 between the closed condition shown in FIG. 15 and an open condition in which the head end portion 292 of the valve member 290 is spaced from the valve seat 288.

Upon operation of the valve actuator assembly 304, the valve actuator rod 296 is moved toward the left (as viewed in FIG. 15) by the valve actuator assembly. The head end portion 292 of the valve member 290 moves away from the valve seat 288. The cleaning material in the chamber 276 then flows around the head end portion 292 of the valve member 290. The cleaning material flows into the chamber 284 in the rod section 270. The cleaning material then flows from the rod section chamber 284 through the nozzle 264 toward the outer end portion 44 of the coating material spray gun 34.

The valve actuator assembly 304 (FIG. 15) operates the valve assembly 282 between the open and closed conditions. The valve actuator assembly 304 has the same construction and mode of operation as the valve actuator assembly 162 (FIG. 5) in the coating material spray gun 34. Thus, the valve actuator assembly 304 includes a circular piston 308 having internal threads which engage external threads on the valve actuator rod 296. The piston 308 is disposed in a piston chamber 310 formed in the body section 260 of the cleaning material spray gun 42. The piston chamber 310 is connected in fluid communication with the control fluid (air) conduit 104 through the manifold block 50 and an inlet passage 314 (FIG. 15) formed in the body section 260 of the coating material spray gun 42.

upon operation of the control valve 102 (FIG. 1) to an open condition, control fluid, that is air, under pressure is conducted through the manifold block 50 to the inlet passage 314. The control fluid pressure causes the piston 308 to move toward the left (as viewed in FIG. 15) against the influence of a biasing spring 318. As the piston 308 moves toward the left (as viewed in FIG. 15), the valve actuator rod 296 moves the head end portion 292 of the valve member 290 leftward away from the valve seat 288. This enables cleaning material to flow from the chamber 276 through the open valve assembly 282 into the chamber 284 in the rod section 270. The cleaning material flows from the rod section chamber 284 through the nozzle 264 toward the outer end portion 44 of the cleaning material spray gun 34.

When the flow of cleaning material toward the outer end portion 44 of the spray gun has been maintained for a sufficient length of time to wash away the accumulated coating material, the control valve 102 is actuated to a closed condition by the controller 94 (FIG. 1). Upon operation of the control valve 102 to the closed condition, the conduit 104 is vented to atmosphere. This results in the inlet passage 314 (FIG. 15) and piston chamber 310 being vented to atmosphere through the manifold block 50 and conduit 104.

Upon venting of the piston chamber 310 to atmosphere, the biasing spring 318 moves the piston 308 and valve actuator rod 296 toward the right (as viewed in FIG. 15). This rightward movement of the valve actuator rod 296 moves the valve member 290 from the open position back to the closed position of FIG. 15. Movement of the valve member 290 to the closed position blocks the flow of cleaning material through the valve assembly 282 to thereby interrupt the flow of cleaning material from the nozzle 264 of the coating material spray gun 42.

An annular seal 322 extends radially outwardly from the piston 308 to block fluid flow between the piston and the cylindrical side wall of the piston chamber 310. The seal 322 is preferably a "RULON" seal which is commercially available from Dixon Industries Corporation of Bristol, R.I. It is believed that "RULON" is polytetrafluoroethylene. A seal 324 engages the valve actuator rod 296 to block a flow of control fluid from the piston chamber 310 along valve actuator rod. Although it is preferred to mount the cleaning material spray gun 42 on the manifold block 50 along with the coating material spray gun 34, both spray guns could be utilized without the manifold block.

Manifold Block - Inlet and Outlet Connections

The manifold block 50 connects the coating material spray gun 34 and cleaning material spray gun 42 in fluid communication with the coating material supply conduit 52, coating material return conduit 70, main cleaning material supply conduit 54, and control fluid (air) conduits 100 and 104 (FIG. 1). A vertical rear side 330 (FIG. 17) of the manifold block 50 is connected with the various supply and return conduits 52, 70, 54, 100 and 104 (FIG. 1). A horizontal upper side 332 (FIG. 16) of the manifold block is connected with the coating material spray gun 34 and the cleaning material spray gun 42.

The conduit connections with the vertical rear side 330 (FIGS. 1 and 17) of the manifold block 50 include a coating material inlet port 340 (FIG. 17) which is connected with the coating material supply conduit 52 (FIG. 1). The manifold block 50 also has a coating material outlet port 342 (FIG. 17) which is connected with the coating material return conduit 70 (FIG. 1). A cleaning material inlet port 344 (FIG. 17) in the manifold block 50 is connected with the main cleaning material supply conduit 54 (FIG. 1). A control fluid inlet port 346 (FIG. 17) in the manifold block 50 is connected with the control fluid (air) conduit 100. A second control fluid inlet port 348 in the manifold block 50 is connected with the control fluid (air) conduit 104.

Figure 16:
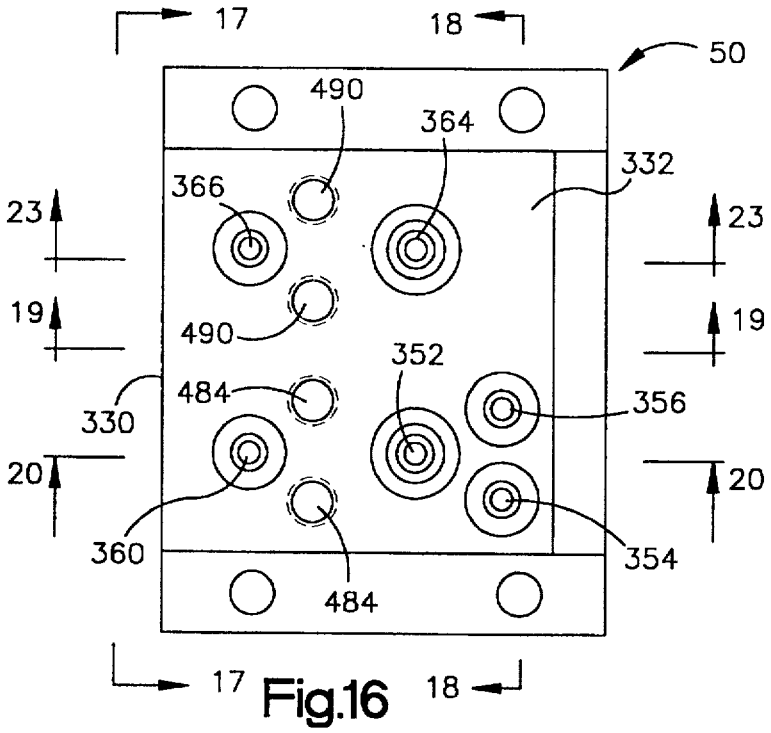
FIG. 16 is a top plan view of the manifold block.

The fluid connections at the upper side 332 of the manifold block with the coating material spray gun 34 and cleaning material spray gun 42 include an application coating material outlet port 352 (FIG. 16). A flow of coating material to be applied to a can 32 by the coating material spray gun 34 leaves the manifold block 50 through the application coating material outlet port 352. The positioning pin 134 (FIG. 5) on the coating material spray gun 34 is telescopically received in the application coating material outlet port 352 (FIG. 16). This enables the coating material to be conducted to the chamber 126 (FIG. 5) in the coating material spray gun 34 from the manifold block 50.

Although many different types of material could be utilized as the heating medium for the coating material spray gun 34, the heated coating material itself is advantageously utilized as the heating medium. A portion of the flow of coating material from the coating material inlet port 340 (FIG. 17) is conducted to a heating medium outlet port 354 (FIG. 16) formed in the upper side 332 of the manifold block 50. The hot coating material flows from the heating medium outlet port 354 in the manifold block 50 to the heating medium inlet port 210 (FIGS. 11, 12 and 24) formed in the coating material spray gun 34.

After the heating medium (coating material) has been conducted through the heater assembly 196 (FIG. 5) in the coating material spray gun 34, the heating medium leaves the coating material spray gun through the outlet port 240 (FIGS. 5 and 24) in the body section 116 of the coating material spray gun. The heating medium (coating material) flows from the coating material spray gun 34 into the manifold block 50 through a heating medium inlet port 356 (FIG. 16).in the upper side 332 of the manifold block. The heating medium inlet port 356 is connected with the heating medium outlet port 342 (FIG. 17) and the return conduit 70 (FIG. 1).

The coating material spray gun 34 is operated from the inactive condition to the active condition directing a flow 36 (FIG. 1) of coating material toward the inside 38 of the can 32 by control fluid pressure, that is, air pressure. A control fluid outlet port 360 (FIG. 16) formed in the upper side 332 of the manifold block 50 enables control fluid pressure to flow to the coating material spray gun 34. The control fluid outlet port 360 is connected with the valve actuator assembly 162 (FIGS. 5 and 6) in the coating material spray gun 34 through the inlet passage 180.

Cleaning material for the cleaning material spray gun 42 is conducted from the manifold block 50 to the cleaning material spray gun through a cleaning material outlet port 364 (FIG. 16) formed in the upper side of the manifold block 50. The hollow positioning pin 280 (FIG. 15) on the cleaning material spray gun 42 is telescopically received in the cleaning material outlet port 364 (FIG. 16) in the manifold block 50. Therefore, cleaning material can be conducted from the cleaning material outlet port 364, through the hollow positioning pin 280, to the chamber 276 (FIG. 15) in the cleaning material spray gun 42.

Control fluid pressure (air) for effecting operation of the valve actuator assembly 304 (FIG. 15) in the cleaning material spray gun 42 is conducted from the manifold block 50 at a control fluid outlet port 366 (FIG. 16) formed in the upper side 332 of the manifold block. Control fluid pressure (air) is conducted from the outlet port 366 to the inlet passage 314 (FIG. 15) formed in the body section 260 of the cleaning material spray gun 42. The control fluid pressure is conducted to the valve actuator assembly 304 to effect operation of the valve assembly 282 from the closed condition shown in FIG. 15 to the open condition.

Manifold Block -Coating Material Passages

Figure 17:
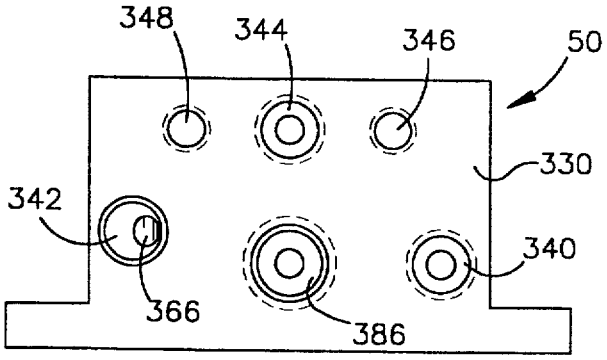
FIG. 17 is a rear end view, taken generally along the line 17—17 of FIG. 16, of the manifold block.

All of the coating material conducted to the manifold block 50 has been heated and enters the manifold block at the coating material inlet port 340 (FIG. 17). From the coating material inlet port 340, the heated coating material flows through a horizontal passage 372 (FIG. 18) to an intersection 374. At the intersection 374, the inlet flow of coating material is divided into a flow of coating material which functions as a heating medium and a flow of coating material which is applied to the cans. The two flows of coating material are maintained separate from each other downstream from the intersection 374. The flow of coating material which functions as a heating medium is conducted straight upwardly from the intersection 374 through a passage 376 to the heating medium outlet port 354 (FIGS. 16 and 18) formed in the upper side 332 of the manifold block 50.

When the valve assembly 138 (FIG. 5) in the coating material spray gun 34 is opened, a pressure drop occurs in the flow of coating material being conducted from the manifold block 50 to the coating material spray gun 34 for application to a can. If the pressure drop is larger than a predetermined pressure drop, the passage 154 through the nozzle 140 (FIG. 5) in the coating material spray gun 34 has become worn and is too large. If the pressure drop is less than a predetermined pressure drop, the coating material spray gun nozzle 140 has become clogged. An apparatus 380 (FIGS. 18 and 19) detects the change in pressure which occurs when the coating material spray gun valve assembly 138 is actuated to the open condition. This enables the condition of the nozzle to be determined and enables corrective action to be taken if the nozzle condition is not satisfactory.

Figure 19:
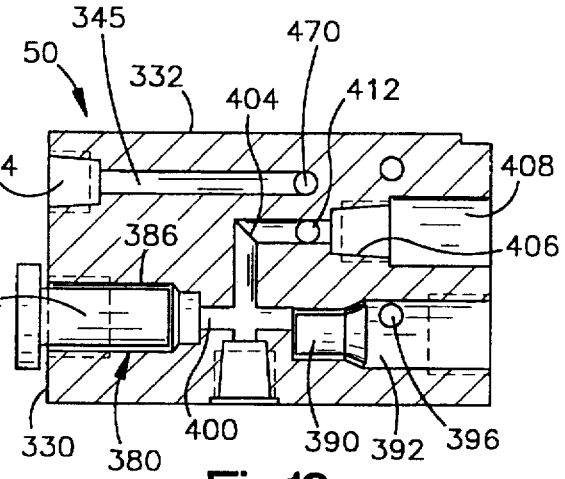
FIG. 19 is a sectional view, taken generally along the line 19—19 of FIG. 16, illustrating the relationship of a restrictor and a transducer to the manifold block.

The apparatus 380 includes a transducer 384 (FIG. 19). The transducer 384 is mounted in a chamber 386 formed in the manifold block 50. The transducer 384 is exposed to the pressure in the flow of coating material conducted to the coating material spray gun valve assembly 138 (FIG. 5). The transducer 384 provides an electrical output signal which is indicative of this pressure.

A restrictor 390 (FIGS. 18 and 19) is mounted in a chamber 392 between the intersection 374 and the transducer 384. The restrictor 390 isolates the transducer 384 from the body Of coating material which functions as a heating medium and from the coating material supply conduit 52 (FIG. 1). The restrictor 390 has the same construction as the restrictor disclosed in U.S. Pat. No. 4,430,886, issued Feb. 14, 1984 and entitled "Method and Apparatus for Sensing Clogged Nozzle" which is incorporated herein by this reference thereto. The transducer 384 cooperates with control circuitry to monitor the condition of the nozzle 140 in the same manner as is disclosed in U.S. Pat. No. 4,668, 948, issued May 26, 1987 and entitled "Dispenser Malfunction Detector" which is incorporated herein by this reference thereto. Although it is preferred to mount the transducer 384 in the manifold block 50, the transducer could be mounted in the coating material spray gun 34 if desired.

Figure 18:
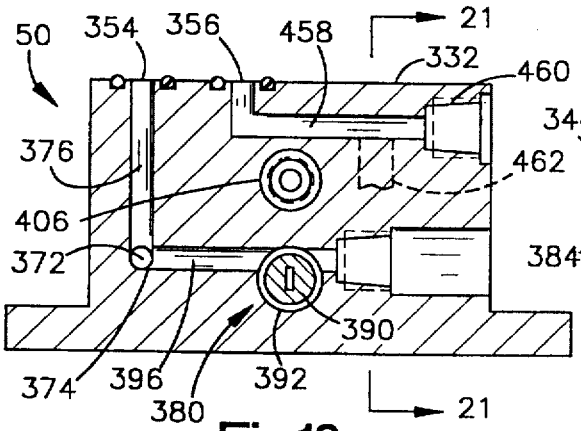
FIG. 18 is a sectional view, taken generally along the line 18—18 of FIG. 16, further illustrating the construction of the manifold block.

The coating material which is to be applied to a can 32 flows from the inlet passage 372 and intersection 374 (FIG. 18) to the restrictor chamber 392 along a passage 396 which intersects the restrictor chamber (FIGS. 18 and 19). The right (as viewed in FIG. 19) end portion of the restrictor chamber 392 is blocked by a suitable plug. Therefore, the coating material flows from the passage 396 through the restrictor 390 into a very short cross passage 400 (FIG. 19) to the transducer chamber 386. Therefore, the transducer 384 is exposed to only coating material which is conducted through the restrictor 390.

From the restrictor 390 and the passage 400, the coating material flows upwardly and sidewardly along a passage 404. The lower end (as viewed in FIG. 19) of the passage 404 is blocked by a suitable plug. The opposite end of the passage 404 is also blocked by a plug which is received in an internally threaded opening 406. The opening 406 (FIG. 19) is located inside the manifold block 50 to minimize the volume of excess coating material contained in the passage 404. Access to the plug in the opening 406 is obtained through an access passage 408.

Figure 20:
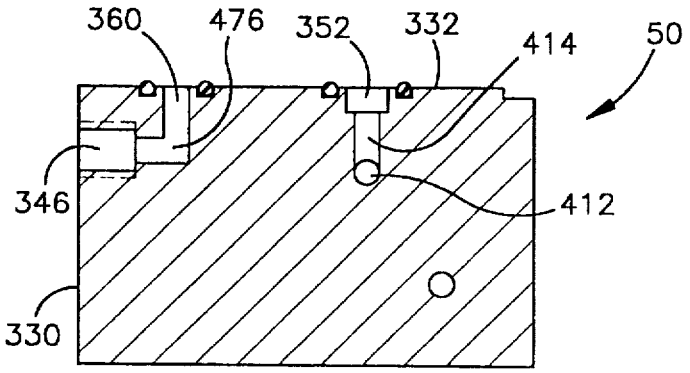
FIG. 20 is a sectional view, taken generally along the line 20—20 of FIG. 16, further illustrating the construction of the manifold block.

The coating material for application to the cans 32 flows from the passage 404 through a passage 412 to a vertically extending passage 414 (FIG. 20). The passage 414 is connected with the application coating material outlet port 352 (FIGS. 16 and 20). From the application coating material outlet port 352, the coating material flows through the hollow positioning pin 134 (FIG. 5) to the chamber 126 in the coating material spray gun 34.

All of the coating material which flows through the coating material outlet port 352 (FIGS. 16 and 20) is applied to the cans 32 by the coating material spray gun 34. However, the coating material which functions as a heating medium in the coating material spray gun 34 is continuously circulated. As was previously mentioned, the heating medium flows to the coating material spray gun 34 from the intersection 374 (FIG. 18) through the passage 376 and heating medium outlet port 354.

Figure 21:
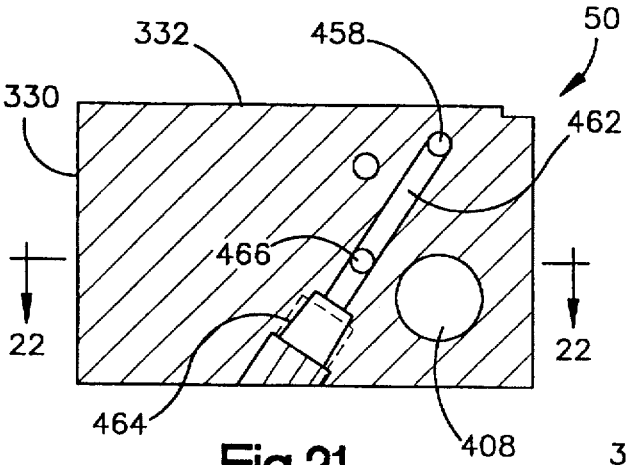
FIG. 21 is a sectional view, taken generally along the line 21—21 of FIG. 18, further illustrating the construction of the manifold block.
Figure 22:
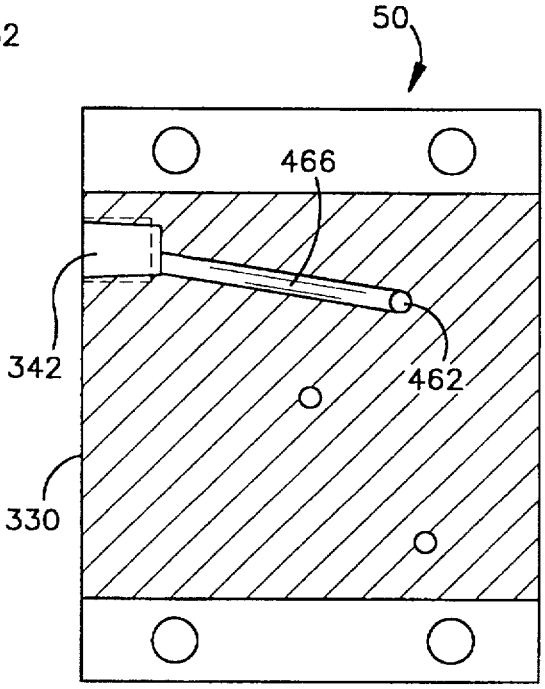
FIG. 22 is a sectional view, taken generally along the line 22—22 of FIG. 21, further illustrating the construction of the manifold block.

The heating medium return flow from the coating material spray gun 34 enters the manifold block at the heating medium inlet port 356 (FIGS. 16 and 18). The return flow of heating medium is conducted downwardly from the inlet port 356 (FIG. 18) to a horizontal passage 458. The end of the passage 458 is blocked by a suitable plug in an internally threaded opening 460. The horizontal passage 458 is connected with a downwardly sloping passage 462 (FIG. 21) formed in the manifold block 50. The lower end of the passage 462 is blocked by a suitable plug in an internally threaded opening 464. The lower end portion of the passage 462 is connected with a passage 466 (FIGS. 21 and 22) which extends horizontally to the heating medium outlet port 342 (FIGS. 17 and 22).

Manifold Block - Cleaning Material Passages

Figure 23:
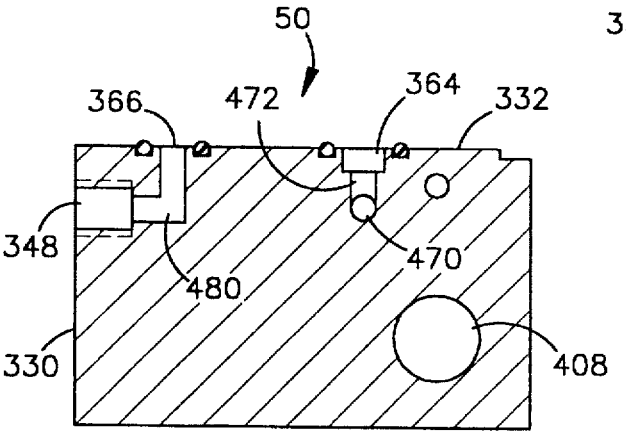
FIG. 23 is a sectional view, taken generally along the line 23—23 of FIG. 16, further illustrating the construction of the manifold block.

The main cleaning material supply conduit 54 (FIG. 1) is connected in fluid communication with the cleaning material inlet port 344 (FIG. 17). From the cleaning material inlet port 344, the cleaning material flows through the manifold block 50 to the cleaning material outlet port 364 (FIG. 16). Thus, from the cleaning material inlet port 344 (FIG. 17), the cleaning material flows horizontally along bore 345 (FIG. 19) to bore 470. The cleaning material then flows along the horizontal passage 470 (FIG. 23) to a vertically extending passage 472 which is connected with the cleaning material outlet port 364. The hollow positioning pin 280 on the cleaning material spray gun 42 is telescopically received by the cleaning material outlet port 364.

Manifold Block - Control Fluid Passages

Control fluid (air) for operating the valve actuator assembly 162 (FIG. 5) in the coating material spray gun 34 is conducted through the manifold block 50 from the control fluid inlet port 346 (FIG. 17) to the control fluid outlet port 360 (FIG. 16). The control fluid flows from the inlet port 346 (FIG. 20) through an L-shaped passage 476 formed in the manifold block 50 and extending between the control fluid inlet port 346 and the control fluid outlet port 360.

Control fluid pressure for operating the cleaning material spray gun 42 is conducted through the manifold block 50 from the control fluid inlet port.348 (FIG. 17) to the control fluid outlet port 366 formed (FIG. 16). Thus, a generally L-shaped passage 480 (FIG. 23) interconnects the control fluid inlet port 348 and the control fluid outlet port 366. The control fluid outlet port 366 is connected with the valve actuator assembly 304 in the cleaning material spray gun 42.

Positioning Spray Guns Relative to Manifold Block

It is important that the coating material spray gun 34 be accurately positioned relative to the manifold block 50. If the coating material spray gun 34 is not accurately positioned relative to the manifold block 50, the nozzle 140 (FIG. 5) at the outer end portion 44 (FIG. 1) of the coating material spray gun 34 will not be accurately positioned relative to the can 32. If the nozzle 140 is not accurately positioned relative to the can 32, the flow 36 of coating material will not be applied in the desired manner to the inside 38 of the can.

In addition, it is important to have the coating material spray gun 34 accurately positioned relative to the manifold block 50 so that the various ports in the upper side 332 of the manifold block are aligned with the various ports in a bottom side 482 of the coating material spray gun. Thus, the coating material outlet port 352 (FIG. 16) at the upper side 332 of the manifold block 50 must be aligned with the coating material inlet passage 132 (FIG. 24) in the body section 116 of the coating material spray gun 34.

The heating medium outlet port 354 (FIG. 16) at the upper 332 side of the manifold block 50 must be accurately aligned with the heating medium inlet port 210 (FIG. 24) through which the heating medium is conducted into the body section 116 of the coating material spray gun 34. The heating medium inlet port 356 (FIG. 16) to the manifold block 50 must be accurately aligned with the heating medium outlet port 240 (FIG. 24) formed in the bottom of the body section 116 of the coating material spray gun 34. Finally, the control fluid outlet port 360 at the upper side 332 of the manifold block 50 must be accurately aligned with the control fluid inlet port 180 (FIG. 24) formed in the bottom of the body section 116 of the coating material spray gun 34.

Figure 24:
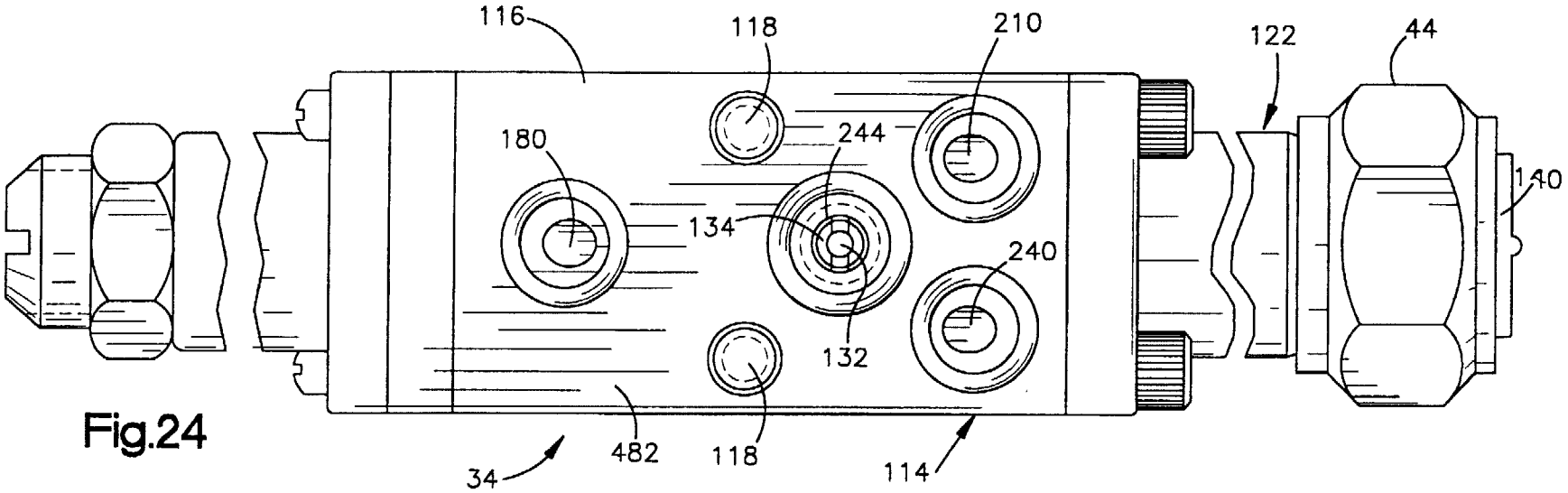
FIG. 24 is a bottom plan view, taken generally along the line 24—24 of FIG. 5, illustrating inlets and outlets formed in the bottom of the coating material spray gun.

To accurately position the coating material spray gun 34 relative to the manifold block 50, a three-point positioning system is utilized. The three-point positioning system includes the positioning pin 134 (FIGS. 5 and 24). The positioning pin 134 extends downwardly from the body section 116 of the coating material spray gun 34 and is telescopically received in the coating material outlet port 352 (FIGS. 16 and 20) formed in the manifold block 50.

The two bolts or fasteners 118 (FIGS. 2 and 24) form the other two members of the three-point positioning system. The bolts 118 extend through the body section 116 of the coating material spray gun 34 into engagement with internally threaded openings 484 (FIG. 16) formed in the manifold block 50. By having a three-point positioning system formed by the hollow positioning pin 134 and the two bolts 118, the coating material spray gun 34 is accurately positioned relative to the manifold block 50. This enables the coating material spray gun 34 to be disconnected from the manifold block 50 for repairs and subsequently reconnected with the manifold block in the same position which it had before being disconnected.

Figure 25:
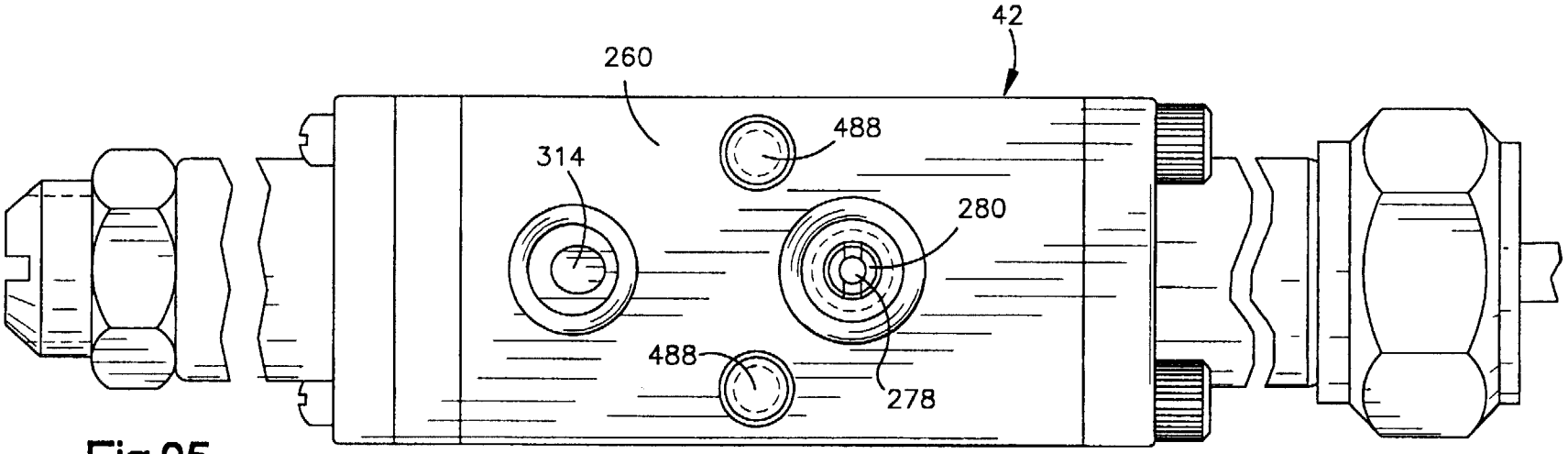
FIG. 25 is a plan view, taken generally along the line 25—25 of FIG. 15, illustrating inlets formed in the bottom of the cleaning material spray gun.

It is also desirable to have the cleaning material spray gun 42 accurately positioned relative to the manifold block 50. Accurate positioning of the cleaning material spray gun 42 is necessary to have the flow of cleaning material accurately directed by the nozzle 264 (FIG. 2) on the cleaning material spray gun toward the nozzle 140 on the coating material spray gun 34. It is also important that the inlet passage 278 (FIG. 25) through which cleaning material flows into the cleaning material spray gun 42 be accurately positioned relative to the cleaning material outlet port 364 (FIG. 16) formed in the manifold block 50. Similarly, it is important to have the control fluid inlet passage 314 (FIG. 25) formed in the cleaning material spray gun 42 accurately positioned relative to the control fluid outlet port 366 (FIG. 16) formed in the manifold block 50.

To accurately position the cleaning material spray gun 42 relative to the manifold block 50, a three-point positioning system is utilized to accurately locate the cleaning material spray gun 42 relative to the manifold block. The three-point positioning system utilized to position the cleaning material spray gun 42 relative to the manifold block 50 is similar to the three-point positioning system used to position the coating material spray gun 34 relative to the manifold block 50. Thus, the hollow positioning pin 280 (FIGS. 15 and 25) is telescopically received in the cleaning material outlet port 364 (FIGS. 16 and 23) formed in the manifold block 50. Bolts 488 (FIGS. 2 and 25) extend through the body section 260 of the cleaning material spray gun 42 into engagement with internally threaded openings 490 (FIG. 16) formed in the manifold block 50. Thus, a three-point positioning system is formed by the hollow positioning pin 280 and the two mounting bolts 488.

Cleaning the Coating Material Spray Gun

Figure 6:
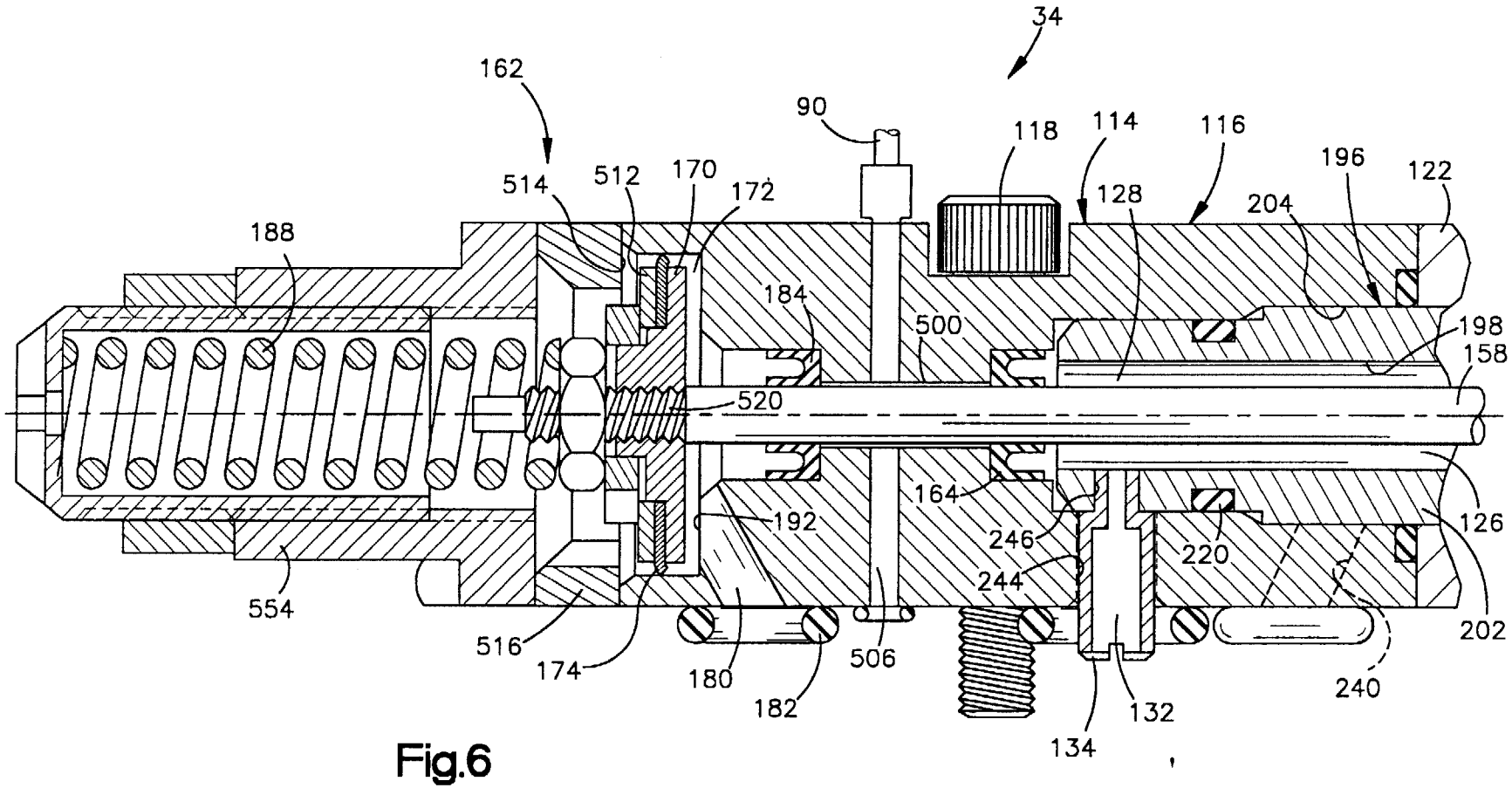
FIG. 6 is an enlarged view of a portion of FIG. 5, further illustrating the construction of the coating material spray gun.

During operation of the coating material spray gun 34 (FIGS. 5 and 6), coating material tends to leak along the valve actuator rod 158 past the seal 164 into a space 500 (FIG. 6). The space 500 is disposed between the seal 164 and the seal 184 for the valve actuator assembly 162. If the coating material is allowed to accumulate in the space 500, the coating material could eventually cause the coating material spray gun 34 to malfunction. In order to prevent this from happening, cleaning material is conducted through the space 500 to remove any coating material which accumulates in the space.

Figure 26:
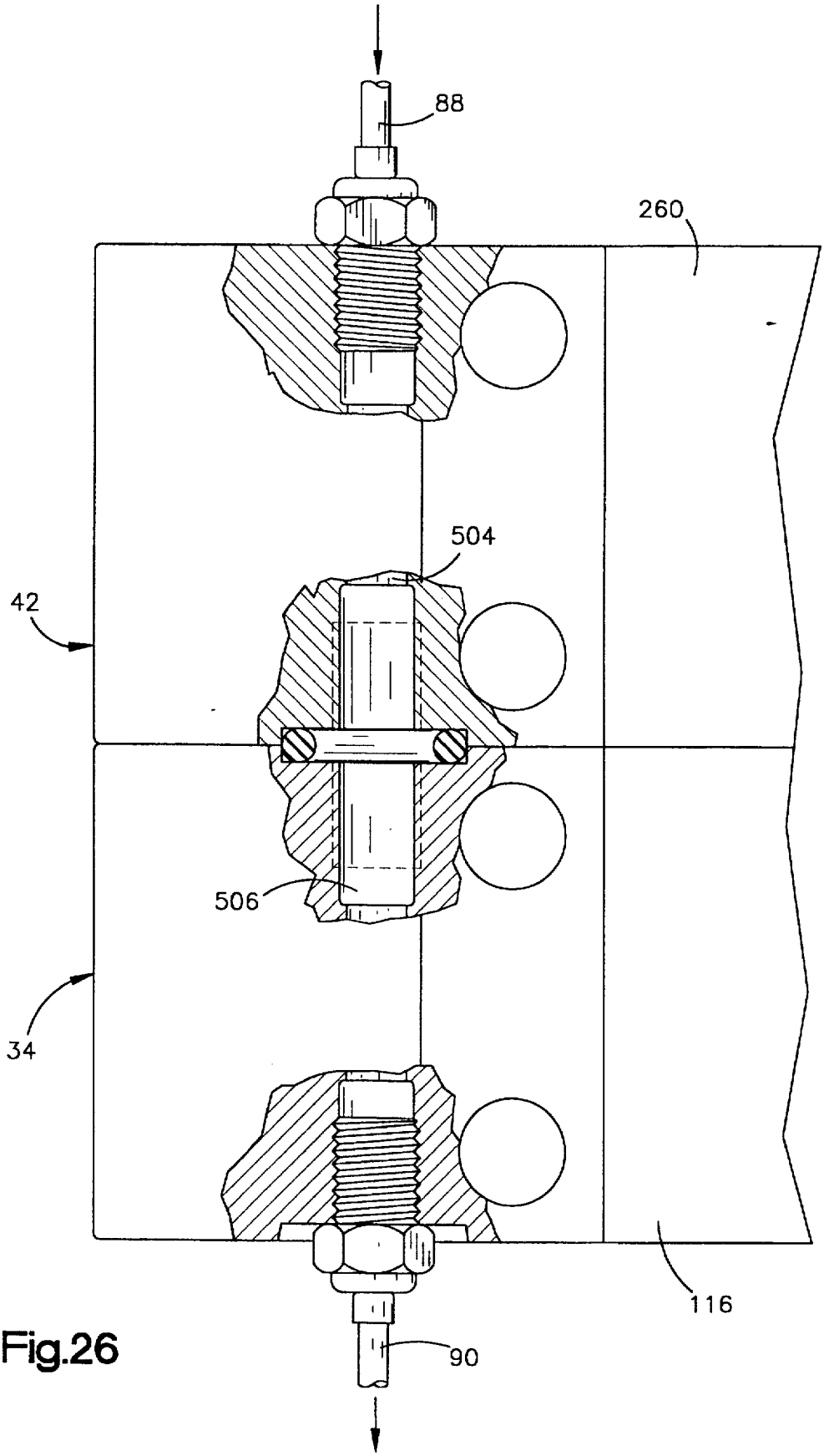
FIG. 26 is an enlarged fragmentary view illustrating the manner in which cleaning material is conducted through the cleaning material spray gun and the coating material spray gun.

To provide for a flow of cleaning material through the space 500, the secondary cleaning material conduit 88 (FIGS. 1 and 26) is connected with the body section 260 of the cleaning material spray gun 42. The cleaning material is conducted through a passage 504 (FIGS. 15 and 26) formed in the body section of the cleaning material spray gun 260 to a passage 506 (FIG. 26) formed in the body section 116 of the coating material spray gun 34. The cleaning material flows from the passage 506 into the space 500 around the valve actuator rod 158 (FIG. 6).

It should be noted that, for purposes of clarity of illustration, the passages 504 and 506 have been illustrated in FIGS. 5, 6 and 15 in positions which are offset by 90° from the actual positions of the passages 504 and 506. Thus, the longitudinal central axes of the passages 504 and 506 extend parallel to the upper side surface 332 of the manifold block 50 rather than perpendicular to the upper side surface of the manifold block, as shown in FIGS. 5, 6 and 15.

After flowing around the portion of the valve actuator rod disposed in the space 500 between the seals 164 and 184 (FIG. 6), the cleaning material flows out of the coating material spray gun 34 to the return conduit 90. The spatial relationship of the inlet conduit 88 through which cleaning material is conducted into the cleaning material spray gun 42 and return conduit 90 through which cleaning material is conducted from the coating material spray gun 34 is correctly shown in FIG. 4. It should be understood that the orientation of the conduits 88 and 90 have been offset in FIGS. 5, 6 and 15 from their actual positions for purposes of clarity of illustration.

When the cleaning material flows through the passage 504 (FIG. 26) in the body section 260 of the cleaning material spray gun 42, the cleaning material flows around the valve actuator rod 296 (FIG. 15). This results in the valve actuator rod 296 for the cleaning material spray gun 42 being cleaned even though this is not necessary. Thus, only cleaning material can leak along the valve actuator rod 296 (FIG. 15) from the chamber 276. Only air can leak along the valve actuator rod 296 from the valve actuator assembly 304 past the seal 324. Therefore, conducting of the cleaning material through the cleaning material spray gun 42 to the coating material spray gun 34 is not necessary from an operational standpoint and is only done for purposes of convenience due to the side-by-side relationship of the coating material spray gun to the cleaning material spray gun. It is contemplated that the cleaning material for removing any coating material which leaks past the seal 164 in the coating material spray gun 34 could be conducted to the space 500 from the manifold block 50 rather than being conducted through the cleaning material spray gun 42.

Adjusting Valve Member Operating Stroke

In order to direct the flow 36 (FIG. 1) of coating material toward the inside 38 of the can 32 in the desired manner and at the desired flow rate, it is important that the operating stroke of the valve member 146 (FIG. 5) be accurately set. Since the valve member 146 is moved through its operating stroke by the piston 170 in the valve actuator assembly 162, the extent of movement of the piston is adjustable in order to obtain the desired valve operating stroke.

When the valve member 146 is moved through its operating stroke to a fully open position, the piston 170 moves leftward (as viewed in FIG. 6). The leftward movement of the piston 170 continues until an annular backup washer 512 on the left (as viewed in FIG. 6) side of the seal 174 abuts a stationary annular stop surface 514 on the housing 114. The stop surface 514 is formed on a spacer section 516 of the housing 114. The spacer section 516 is connected to the body section 116 of the coating material spray gun 34.

The position of the piston 170 and the backup washer 512 relative to the valve actuator rod 158 is adjustable to adjust the operating stroke of the movable valve member 146. Thus, external threads 520 (FIG. 6) formed on the end portion of the valve actuator rod 158 enable the valve actuator rod to be rotated about its longitudinal central axis to move the piston 170 and backup washer 512 either toward or away from the stop surface 514. By rotating the valve actuator rod 158 to move the piston 170 and backup washer 512 toward the right (as viewed in FIG. 6), the piston 170 and backup washer 512 are moved away from the stop surface 514. This results in the operating stroke of the movable valve member 146 (FIG. 5) being increased. Conversely, if the valve actuator rod 158 is rotated about its central axis to cause the actuator rod thread 520 to move the piston 170 and backup washer 512 toward the stop surface 514, the operating stroke of the valve member 146 is decreased.

Figure 27:
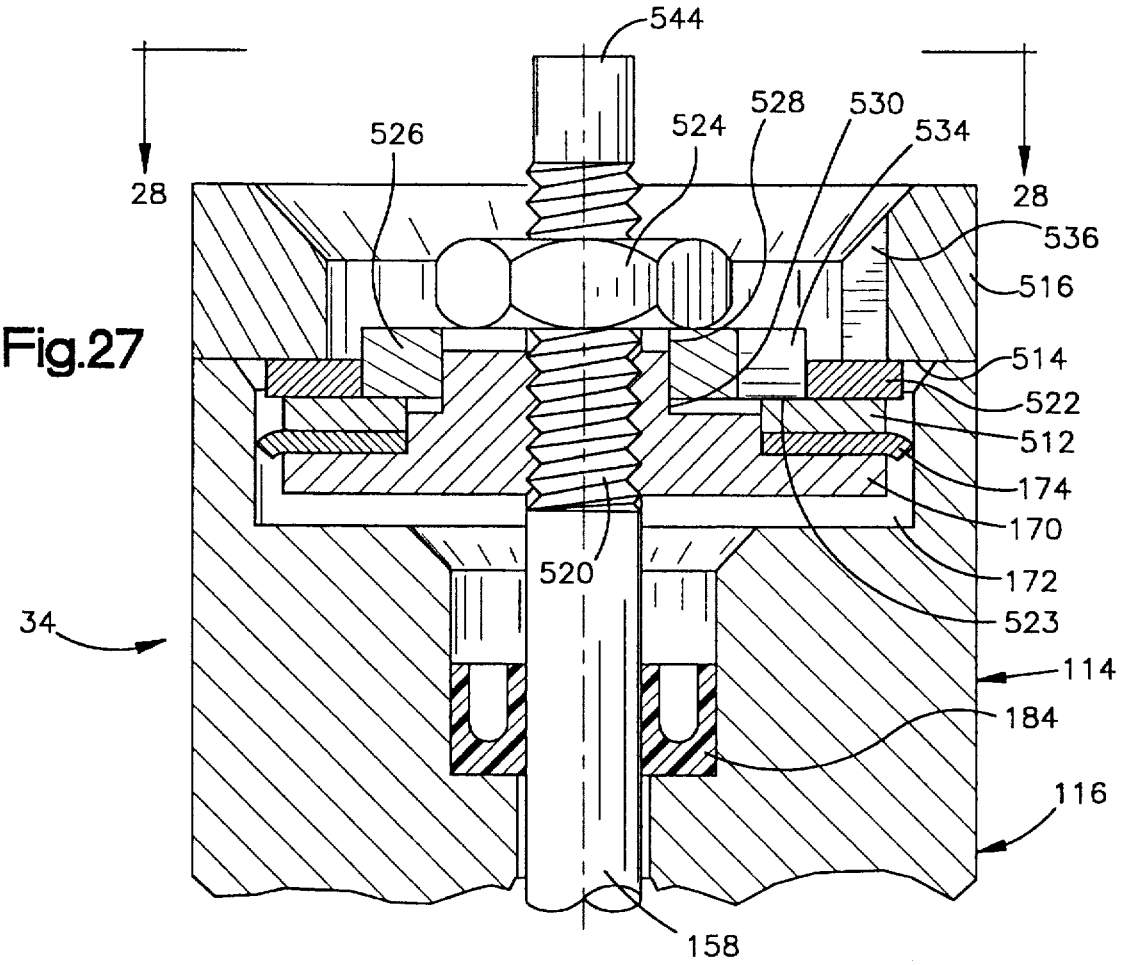
FIG. 27 is an enlarged fragmentary sectional view of a portion of the coating material spray gun and illustrating the manner in which a spacer member is positioned during adjustment of a valve actuator member.

An annular shim or spacer member 522 (FIG. 27) is used to adjust the operating stroke of the movable valve member 146. The shim 522 has an axial thickness which is the same as the desired distance through which the valve member 138 is to be moved between the fully closed and fully open positions. Prior to completing assembly of the housing 114, the shim 522 is placed on an upwardly facing side surface 523 of the backup washer 512 (FIG. 27). The spacer section 516 is then bolted to the body section 116 of the coating material spray gun 34.

When the shim 522 is placed on the backup washer 512, the piston 170 is near the lower (as viewed in FIG. 27) end of the threads 520 on the valve actuator rod 158. Therefore, when the spacer member 516 is secured to the body section 116 of the coating material spray gun 34, there will be space between the upper (as viewed in FIG. 27) side surface of the shim 522 and the stop surface 514 on the spacer member 516. At this time, a locknut 524 is near the upper (as viewed in FIG. 27) end of the threads 520 on the valve actuator rod 158.

The upper side surface of the shim 522 is moved into abutting engagement with the stop surface 514. To effect abutting engagement between the upper side surface of the shim 522 and the stop surface 514, the valve actuator rod 158 is rotated in a clockwise direction (as viewed in FIG. 28). This causes the threaded connection between the piston 170 and valve actuator rod 158 to move the piston upwardly (as viewed in FIG. 27).

Figure 28:
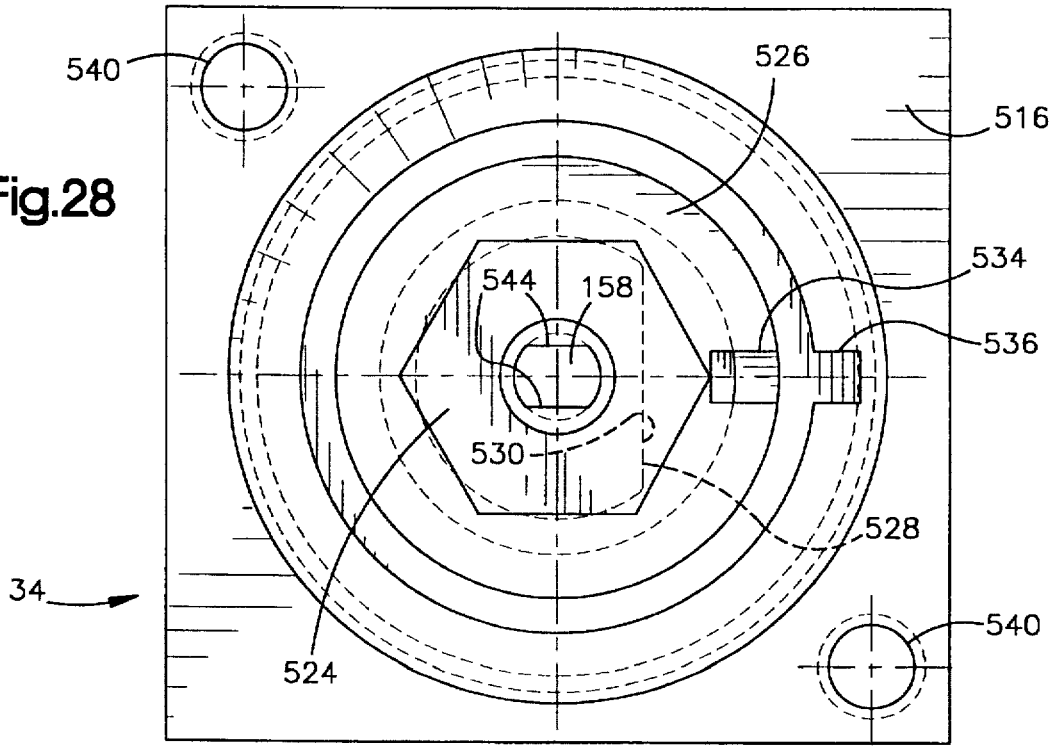
FIG. 28 is a plan view, taken generally along the line 28—28 of FIG. 27.

During rotation of the valve actuator rod 158 to raise the piston 170, the piston must be held against rotation relative to the housing 114. To enable the piston 170 to be held against rotation relative to the housing 114, a D-hole washer 526 (FIGS. 27 and 28) is mounted on the upper end portion of the piston 170. The D-hole washer 526 has a central opening with a flat side surface 528. The flat side surface 528 on the central opening in the D-hole washer 526 is engaged by a flat side surface 530 formed on the upper end portion of the piston 170 (FIG. 27). A slot 534 in the D-hole washer 526 is aligned with a slot 536 formed in the spacer section 516 (FIG. 28).

A screwdriver or specially-shaped retainer member is inserted into the slots 534 and 536 formed in the D-hole washer 526 and spacer section 516 to hold the piston 170 against rotation relative to the body section 116 of the coating material spray gun 34. Thus, the D-hole washer 526 is held against rotation relative to the piston by engagement of the flat 528 on the D-hole washer 526 with the flat 530 on the piston 170. The spacer section 516 is fixedly secured to the body section 116 by suitable bolts received in holes 540 (FIG. 28) formed in the end section 516 and extending into internally threaded holes formed in the body section 116.

A wrench is utilized to engage flats 544 formed on opposite Sides of the upper (as viewed in FIG. 27) end portion of the valve actuator rod 158. During rotation of the valve actuator rod 158, the piston 170 is held against rotation by engagement of the screw driver or retainer member with the slots 534 and 536 in the D-hole washer 526 and spacer section 516. This results in the piston 170 being moved upwardly (as viewed in FIG. 27) along the valve actuator rod 158 by the threads 520 as the valve actuator rod is rotated.

When the upper side surface of the shim 522 abuttingly engages the stop surface 514, the valve member 146 (FIG. 5) is firmly pressed against the valve seat 144. Thus, at this time, the valve member 146 will be in its closed position. The locknut 524 is then moved downwardly against the D-hole washer 526 to lock the piston 170 against further rotation relative to the valve actuator rod 158.

The bolts holding the spacer section 516 in position on the body section 116 are then removed. The spacer section 516 is moved away from the body section 116. The shim 522 is then removed. Once the shim has been removed, the spacer section 516 is again positioned in engagement with the body section 116. At this time, the space between the upper side surface of the backup washer 512 and the stop surface 514 will correspond exactly to the axial thickness of the shim 522 and the desired operating stroke of the valve member 146.

A biasing spring housing 554 (FIGS. 5 and 6) is then positioned in abutting engagement with the spacer section 516. Suitable bolts are then utilized to connect the biasing spring housing 554 with the body section 116 of the coating material spray gun 34. These bolts extend through the spacer section 516. Once this has been done, the biasing spring 188 will urge the piston 170 toward the right (as viewed in FIG. 5) to press the valve member 146 against the valve seat 144.

When fluid pressure is conducted to the piston chamber 172 through the inlet passage 180, the piston 170 is moved toward the left (as viewed in FIG. 5) through an operating stroke which is the same as the axial thickness of the shim 522. Therefore, the valve member 146 is moved through the desired distance to a fully open position by the piston 170.

The foregoing description has related only to the manner in which the coating material spray gun 34 is assembled to provide the valve member 146 with a desired operating stroke. However, it should be understood that the cleaning material spray gun 42 (FIG. 15) is assembled in the same way to provide the valve member 290 with a desired operating stroke.

Conclusion

The present invention provides a new and improved apparatus 30 and method for use in applying coating material to at least a portion of an inner surface of a can 32. A coating material spray gun 34 is connected with a manifold block 50 and is operable to direct a flow 36 of coating material toward the inner surface of the can 32. A cleaning material spray gun 42 is also connected with the manifold block 50 and is operable to direct a flow of cleaning material toward a nozzle 140 of the coating material spray gun 34. The coating material spray gun 34 and the cleaning material spray gun 42 may be accurately positioned relative to the manifold block by using at least three positioning elements for each of the spray guns. Thus, the coating material spray gun 34 is positioned by the positioning pin 134 and two bolts 118. The cleaning material spray gun is positioned by the positioning pin 280 and the two bolts 488. A flow of cleaning material is conducted through the coating material spray gun 34 to clean at least a portion of the coating material spray gun.

The coating material spray gun 34 includes a heater assembly 196 which heats coating material in the coating material spray gun. The heater assembly 196 conducts a heating medium along a chamber 126 in which a stagnant body of coating material is held when the coating material spray gun 34 is in an inactive condition. The heating medium is preferably heated coating material.

During operation of the coating material spray gun 34 between an inactive and active condition, the fluid pressure in a passage 404 (FIG. 19) through which coating material flows will vary. A transducer 384 is exposed to the fluid, pressure in the passage 404 to sense changes in the pressure in the passage. The transducer is isolated from the coating material conducted through the heater assembly 196 by a restrictor 390.

A valve assembly 138 or 282 in either the coating material spray gun 34 (FIG. 5) or the cleaning material spray gun can 42 (FIG. 15) can be adjusted so that a valve member 146 or 290 moves through a predetermined distance between a fully open and a fully closed position. During adjusting of the distance through which the valve member 146 moves, a spacer member or shim 522 is placed between a surface connected with the valve member and a surface 514 connected with the housing 114. After the valve member 146 has been adjusted to press the spacer member or shim 522 against the surface 514 on the housing 114, the spacer member is removed.

Having described a specific preferred embodiment of the invention, the following is claimed:

1. A method of applying coating material to at least a portion of an inner surface of a can, said method comprising the steps of providing a coating material spray gun and a cleaning material spray gun which are disposed adjacent to each other and are connected with a manifold block, conducting a flow of coating material to the manifold block, conducting a flow of cleaning material to the manifold block, conducting a flow of coating material from the manifold block to the coating material spray gun, directing a flow of coating material from the coating material spray gun toward the inner surface of the can, said step of directing a flow of coating material from the coating material spray gun toward the inner surface of the can including conducting a flow of coating material through a nozzle of the coating material spray gun, conducting a flow of cleaning material from the manifold block to the cleaning material spray gun, and directing a flow of cleaning material from the cleaning material spray gun toward the nozzle of the coating material spray gun.

2. A method as set forth in claim 1 further including the steps of heating a body of coating material in the coating material spray gun while maintaining the body of coating material stagnant.

3. A method as set forth in claim 2 wherein said step of heating the body of coating material in the coating material spray gun while maintaining the body of coating material stagnant includes conducting a flow of heated coating material from the manifold block to the coating material spray gun and conducting the flow of heated coating material along a flow path which is at least partially disposed in the coating material spray gun and is separate from the stagnant body of coating material.

4. A method as set forth in claim 1 further including the steps of conducting a flow of coating material along a flow path which extends through the coating material spray gun during performance of said step of directing a flow of coating material from the coating material spray gun toward the inner surface of the can, and conducting a flow of cleaning material along a flow path which extends through the cleaning material spray gun and is generally parallel to the coating material flow path in the coating material spray gun, said step of directing a flow of cleaning material from the cleaning material spray gun toward the nozzle of the coating material spray gun includes directing the flow of cleaning material in a direction which extends transversely to the flow path of cleaning material in the cleaning material spray gun.

5. A method as set forth in claim 1 further including the step of conducting a flow of cleaning material through a portion of the coating material spray gun to clean a portion of the coating material spray gun.

6. A method as set forth in claim 1 wherein said step of conducting a flow of coating material from the manifold block to the coating material spray gun includes conducting the flow of coating material along a first flow path, said method further including the step of conducting a flow of heated coating material from the manifold block through the coating material spray gun and back to the manifold block along a second flow path to heat a portion of the coating material spray gun.

7. A method as set forth in claim 1 further including the step of positioning the coating material spray gun on the manifold block with a plurality of positioning elements which extend between the coating material spray gun and the manifold block, said step of conducting a flow of coating material from the manifold block to the coating material spray gun including conducting coating material through one of the positioning elements.

8. A method as set forth in claim 1 further including the step of supporting the coating material spray gun and the cleaning material spray gun on the manifold block in a side-by-side relationship during performance of said step of directing a flow of cleaning material from the cleaning material spray gun toward the nozzle of the coating material spray gun.

9. A method as set forth in claim 1 further including the steps of conducting motive fluid pressure to the manifold block, conducting motive fluid pressure from the manifold block to the coating material spray gun, operating the coating material spray gun under the influence of motive fluid pressure conducted from the manifold block to the coating material spray gun, said step of operating the coating material spray gun including operating the coating material spray gun from an inactive condition in which the coating material spray gun is ineffective to direct a flow of coating material toward the inner surface of the can to an active condition in which the coating material spray gun is effective to direct a flow of coating material toward the inner surface of the can, conducting motive fluid pressure from the manifold block to the cleaning material spray gun, operating the cleaning material spray gun under the influence of motive fluid pressure conducted from the manifold block to the cleaning material spray gun, said step of operating the cleaning material spray gun including operating the cleaning material spray gun from an inactive condition in which the cleaning material spray gun is ineffective to direct a flow of cleaning material toward the nozzle of the coating material spray gun to an active condition in which the cleaning material spray gun is effective to direct a flow of cleaning material toward the nozzle of the coating material spray gun.

10. A method of applying coating material to at least a portion of a can, said method comprising the steps of supporting a coating material spray gun and a cleaning material spray gun on one manifold block, conducting a flow of coating material through the one manifold block to the coating material spray gun, directing a flow of coating material from the coating material spray gun toward the can, conducting a flow of cleaning material through the one manifold block to the cleaning material spray gun, and conducting a flow of cleaning material from the cleaning material spray gun toward the coating material spray gun.

11. A method as set forth in claim 10 further including the steps of stopping the flow of coating material from the coating material spray gun, maintaining a body of coating material in the coating material spray gun stagnant, and heating the stagnant body of coating material in the coating material spray gun.

12. A method as set forth in claim 10 wherein said step of supporting a coating material spray gun and supporting a cleaning material spray gun on one manifold block includes supporting the coating material spray gun and the cleaning material spray gun on the one manifold block in a side-by-side relationship.

13. A method as set forth in claim 10 further including the steps of conducting a flow of coating material along a flow path which extends through the coating material spray gun during performance of said step of directing a flow of coating material from the coating material spray gun toward the can, and conducting a flow of cleaning material along a flow path which extends through the cleaning material spray gun and is generally parallel to the coating material flow path in the coating material spray gun, said step of directing a flow of cleaning material from the cleaning material spray gun toward the coating material spray gun includes directing the flow of cleaning material in a direction which extends transversely to the flow path of cleaning material in the cleaning material spray gun.

14. A method as set forth in claim 10 further including the step of conducting a flow of cleaning material through a portion of the coating material spray gun to clean a portion of the coating material spray gun.

15. A method of applying coating material to at least a portion of an inner surface of a can, said method comprising the steps of providing a coating material spray gun and a cleaning material spray gun which are disposed adjacent to each other, conducting a flow of coating material along a flow path which extends through the coating material spray gun, directing a flow of coating material from the coating material spray gun toward the inner surface of the can, said step of directing a flow of coating material from the coating material spray gun toward the inner surface of the can including conducting a flow of coating material through a nozzle of the coating material spray gun, conducting a flow of cleaning material through the cleaning material spray gun along a flow path which extends generally parallel to the coating material flow path in the coating material spray gun, and directing a flow of cleaning material from the cleaning material spray gun toward the nozzle of the coating material spray gun in a direction which extends transversely to the flow path of cleaning material through the cleaning material spray gun.

16. A method as set forth in claim 15 further including the step of conducting a flow of cleaning material through a portion of the coating material spray gun to clean a portion of the coating material spray gun.

17. A method as set forth in claim 15 further including the step of conducting a flow of heated coating material through the coating material spray gun along a second flow path to heat a portion of the coating material spray gun.

18. A method as set forth in claim 15 further including the steps of supporting the coating material spray gun on a manifold block and conducting a flow of coating material through the manifold block to the coating material spray gun during performance of said step of directing a flow of coating material from the coating material spray gun toward the inner surface of the can, supporting the cleaning material spray gun on the same manifold block as the coating material spray gun and conducting a flow of cleaning material through the manifold block to the cleaning material spray gun during performance of said step of directing a flow of cleaning material from the cleaning material spray gun toward the nozzle of the coating material spray gun.

19. A method as set forth in claim 15 further including supporting the coating material spray gun and the cleaning material spray gun in a side-by-side relationship on a manifold block during performance of said steps of directing a flow of coating material from the coating materia spray gun toward the inner surface of the can and directing a flow of cleaning material from the cleaning material spray gun toward the nozzle of the coating material spray gun.

20. A method of applying coating material to an article, said method comprising the steps of supporting a coating material spray gun and a cleaning material spray gun in a side-by-side relationship on a manifold block, conducting a flow of coating material to the manifold block, conducting a flow of cleaning material to the manifold block, conducting a flow of coating material from the manifold block to the coating material spray gun, conducting a flow of cleaning material from the manifold block to the cleaning material spray gun, directing a flow of coating material from a nozzle of the coating material spray gun toward the article, interrupting the flow of coating material from the coating material spray gun, and, thereafter, directing a flow of cleaning material from the cleaning material spray gun toward the nozzle of the coating material spray gun while the flow of coating material from the coating material spray gun is interrupted.

21. A method as set forth in claim 20 wherein said step of conducting a flow of coating material from the manifold block to the coating material spray gun is performed during performance of said step of directing a flow of coating material from a nozzle of the coating material spray gun, during performance of said step of interrupting the flow of coating material from the coating material spray gun, and during performance of said step of directing a flow of cleaning material from the cleaning material spray gun.

22. A method of applying coating material to at least a portion of an inner surface of a can, said method comprising the steps of directing a flow of coating material from a body of coating material toward the inner surface of the can, stopping the flow of coating material from the body of coating material to stagnate the body of coating material, and heating the body of coating material while maintaining the body of coating material stagnant, step of heating the body of coating material includes conducting a flow of heated coating material in a first direction along the stagnant body of coating material and conducting a flow of heated coating material in a second direction opposite to the first direction along the stagnant body of coating material.

23. A method of applying coating material to at least a portion of an inner surface of a can, said method comprising the steps of directing a flow of coating material from a body of coating material toward the inner surface of the can, stopping the flow of coating material from the body of coating material to stagnate the body of coating material, heating the body of coating material while maintaining the body of coating material stagnant, heating coating material and conducting a first stream of heated coating material along a first path during performance of said step of directing a flow of coating material toward the inner surface of the can, said step of heating the body of coating material while maintaining the body of coating material stagnant includes conducting a second stream of heated coating material along a second path which is adjacent to and separate from the stagnant body of coating material, said step of conducting a second stream of coating material along a second path includes conducting the second stream of coating material along a path which is disposed along the outside of the stagnant body coating material.

* * * * *

UNITED STATES PATENT AND TRADEMARK OFFICE

CERTIFICATE OF CORRECTION

PATENT NO. : 5,455,067

DATED : October 3, 1995

INVENTOR(S) : Donald A. Chicatelli and Wataru Kakuta

It is certified that error appears in the above-indentified patent and that said Letters Patent is hereby corrected as shown below:

Column 26, line 20, change "materia" to --material--.

Signed and Sealed this

Nineteenth Day of March, 1996

Bruce Lehman

*Attest:*

BRUCE LEHMAN

*Attesting Officer*

*Commissioner of Patents and Trademarks*